US010582790B2

(12) United States Patent
Yuki et al.

(10) Patent No.: US 10,582,790 B2
(45) Date of Patent: Mar. 10, 2020

(54) BOTTLE STORAGE

(71) Applicant: Panasonic Intellectual Property Management Co., Ltd., Osaka (JP)

(72) Inventors: Yasuhiro Yuki, Kanagawa (JP); Masahiro Ishii, Hyogo (JP); Akira Kataoka, Shiga (JP); Rinako Kamei, Tokyo (JP); Toyoshi Kamisako, Shiga (JP); Masanori Fukata, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 193 days.

(21) Appl. No.: 15/891,009

(22) Filed: Feb. 7, 2018

(65) Prior Publication Data

US 2018/0235392 A1 Aug. 23, 2018

(30) Foreign Application Priority Data

Feb. 23, 2017 (JP) ..... 2017-032640
Oct. 30, 2017 (JP) ..... 2017-208810

(51) Int. Cl.

| | |
|---|---|
| ***A47G 23/02*** | (2006.01) |
| ***B65D 81/18*** | (2006.01) |
| ***F25D 31/00*** | (2006.01) |
| ***F25B 21/02*** | (2006.01) |

(52) U.S. Cl.

CPC ..... *A47G 23/0241* (2013.01); *B65D 81/18* (2013.01); *F25B 21/02* (2013.01); *F25D 31/006* (2013.01); *F25D 2303/0841* (2013.01); *F25D 2327/001* (2013.01); *F25D 2400/40* (2013.01); *F25D 2500/02* (2013.01); *F25D 2700/12* (2013.01); *F25D 2700/16* (2013.01)

(58) Field of Classification Search

CPC ... A47G 23/0241; F25B 21/02; F25D 31/006; F25D 2303/0841; F25D 2327/001; F25D 2700/12; F25D 2700/16; F25D 2500/02; F25D 2400/40; F25D 31/007; F25D 2700/06; F25D 2331/809; F25D 31/005; F25D 29/005; B65D 81/18

See application file for complete search history.

(56) References Cited

U.S. PATENT DOCUMENTS 3,167,925 A * 2/1965 Elfving ..... F25B 21/02 62/3.6
4,244,650 A * 1/1981 Garfunkel ..... B07C 5/126 250/223 B
5,028,769 A * 7/1991 Claypool ..... B07C 5/3412 235/454

(Continued)

FOREIGN PATENT DOCUMENTS

JP 2010-047313 3/2010

*Primary Examiner* — Ljiljana V. Ciric
(74) *Attorney, Agent, or Firm* — Greenblum & Bernstein, P.L.C.

(57) ABSTRACT

A bottle storage includes a container that contains a bottle; a cooling-warming apparatus provided to surround a position where the bottle is contained; and an image capturer that captures an image of the bottle contained in the container. The cooling-warming apparatus has a gap at least at a portion of the cooling-warming apparatus corresponding to at least a part of an image capturing region of the image capturer.

14 Claims, 26 Drawing Sheets

(56) References Cited

U.S. PATENT DOCUMENTS 6,028,302 A * 2/2000 Wiejak ..... B07C 5/3412 209/524
6,137,900 A * 10/2000 Steidel ..... B07C 5/3408 382/142
6,272,777 B1 * 8/2001 Swenson ..... G09F 3/10 215/365
6,275,603 B1 * 8/2001 Cronshaw ..... G01N 21/9027 250/223 B
6,556,690 B1 * 4/2003 Nelson ..... G06K 7/10544 235/468
6,746,053 B1 * 6/2004 Afzali-Ardakani ..... G06K 19/06028 206/459.5
6,989,857 B2 * 1/2006 Furnas ..... G01N 21/21 250/223 B
8,368,539 B2 * 2/2013 Adstedt ..... B65D 55/028 340/572.1
8,823,770 B2 * 9/2014 Brunner ..... H04N 5/23238 348/36
8,854,213 B2 * 10/2014 Adstedt ..... B65D 39/00 340/500
2002/0097195 A1 * 7/2002 Frank ..... G09F 23/00 345/5
2003/0034392 A1 * 2/2003 Grimm ..... G06Q 10/087 235/385
2004/0018289 A1 * 1/2004 McQueeny ..... G09F 3/0288 426/538
2004/0140304 A1 * 7/2004 Leyendecker ..... A47J 36/2433 219/386
2006/0032923 A1 * 2/2006 Krupa ..... B42D 15/0053 235/462.01
2006/0053805 A1 * 3/2006 Flinner ..... F25B 21/04 62/3.2
2006/0117760 A1 * 6/2006 Pieronczyk ..... F25B 21/04 62/3.3
2006/0120751 A1 * 6/2006 McVicker ..... G06K 9/20 399/107
2006/0120752 A1 * 6/2006 McVicker ..... G06K 9/20 399/107
2006/0131404 A1 * 6/2006 Dervishian ..... G06Q 99/00 235/385
2006/0144938 A1 * 7/2006 David ..... G06Q 10/087 235/385
2006/0185372 A1 * 8/2006 Conde Hinojosa ..... A23L 3/36 62/64
2006/0208172 A1 * 9/2006 Akkerman ..... G01N 21/9036 250/223 B
2006/0283145 A1 * 12/2006 Weisgerber ..... B07C 5/3404 53/167
2007/0042684 A1 * 2/2007 Park ..... B24C 1/04 451/29
2007/0143190 A1 * 6/2007 Banerjee ..... G06Q 10/02 705/26.1
2007/0191983 A1 * 8/2007 Griffits ..... A47G 19/2227 700/213
2008/0056556 A1 * 3/2008 Eller ..... G06F 19/3462 382/142
2008/0140432 A1 * 6/2008 Fenn ..... G06Q 10/087 705/317
2009/0100843 A1 * 4/2009 Wilkinson ..... F25B 21/02 62/3.7
2009/0145138 A1 * 6/2009 Ethier ..... F25D 31/007 62/3.6
2010/0058776 A1 * 3/2010 Loibl ..... F25D 31/007 62/3.3
2014/0021207 A1 * 1/2014 Noble, Jr. ..... B65D 81/18 220/592.17
2014/0250919 A1 * 9/2014 Obermaier ..... F25B 21/02 62/3.64
2015/0305979 A1 * 10/2015 Tintinger ..... A61J 1/165 62/3.62
2016/0018138 A1 * 1/2016 Liptak ..... F25B 21/04 62/3.3
2016/0182868 A1 * 6/2016 Izawa ..... G03B 17/02 62/125
2016/0236605 A1 * 8/2016 Doi ..... B60N 3/104
2017/0042373 A1 * 2/2017 Alexander ..... A47J 36/2472
2017/0205138 A1 * 7/2017 Hwang ..... F25D 25/024
2018/0040795 A1 * 2/2018 Lam ..... H01L 35/30
2018/0235392 A1 * 8/2018 Yuki ..... A47G 23/0241
2018/0240229 A1 * 8/2018 Yuki ..... G06T 7/0004
2019/0151808 A1 * 5/2019 Giardullo ..... B01F 3/04794

* cited by examiner

FIG. 14

| DATE | TIME | LID | CID | WEIGHT (WITHOUT BOTTLE) |
|---|---|---|---|---|
| 2011/1/4 | 19:30 | L1 | C11 | 650 |
| | 19:40 | L2 | C11 | 590 |
| | 19:55 | L3 | C11 | 555 |
| | 20:05 | L4 | C12 | 320 |
| | 20:17 | L5 | C12 | 150 |
| | 20:23 | L6 | C12 | 70 |
| 2011/1/8 | 21:11 | L7 | C21 | 630 |
| | 21:23 | L8 | C21 | 510 |
| ••• | ••• | ••• | ••• | ••• |

BOTTLE STORAGE

BACKGROUND

1. Technical Field

The present disclosure relates to a bottle storage for storing a bottle such as a wine bottle.

2. Description of the Related Art

Wine is regularly drunk all over the world. Also, sake has begun to spread worldwide and is distributed in bottles (720 ml) of substantially the same size as wine bottles.

Wine can be stored at constant temperature in a wine cellar. A typical wine cellar electrically cools wine by using a compressor, fan, or the like. Although wine cellars are superior in managing the temperature, they are large and hard to carry. In addition, the compressor or the fan generates noise, and thus, wine cellars are not often suitable to be used at tables.

Thus, a wine cooler that cools wine with ice and water serves as a bottle storage at tables. However, wine coolers with ice and water have the disadvantage of cooling wine to be cooler than appropriate temperatures (e.g., 5 to 20° C.). In addition, a wine bottle gets wet by using such a wine cooler, and the water around the bottle needs to be wiped off with a towel every time the bottle is taken out of the wine cooler before wine is poured into a glass.

As a measure against such inconvenience, Japanese Patent No. 4406683 proposes a wine cooler in which a refrigerant can be fixed in a detachable manner on an inner wall of a refrigerating container. Japanese Patent No. 4406683 discloses that the temperature can be flexibly adjusted by adjusting the quantity or size of the refrigerant.

SUMMARY

However, the wine cooler disclosed in Japanese Patent No. 4406683 needs further improvement.

In one general aspect, the techniques disclosed here feature a bottle storage including: a container that contains a bottle; a cooling-warming apparatus provided to surround a position where the bottle is contained; and an image capturer that captures an image of the bottle contained in the container. The cooling-warming apparatus has a gap at least at a portion of the cooling-warming apparatus corresponding to at least a part of an image capturing region of the image capturer.

These general and specific aspects may be implemented using a system, a method, and a computer program, and any combination of systems, methods, and computer programs.

According to the aspect of the present disclosure, it is possible to cool the bottle and to provide an added value based on image capturing of the bottle.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 14 illustrates an example of a weight history log stored in a log information storage;

DETAILED DESCRIPTION

Now, embodiments of the present disclosure will be described below in detail with reference to the drawings as appropriate. Note that detailed description more than necessary will be omitted in some cases. For example, a well known item will not be described in detail, and components that are substantially the same will not be repeatedly described, in some cases. This prevents the following description from becoming unnecessarily redundant and makes it easier for a person skilled in the art to understand the present disclosure.

Note that the attached drawings and the following description are provided so that a person skilled in the art can fully understand the present disclosure and is not intended to limit the subject matter of the claims.

<1> Fundamental Configuration of Bottle Storage

Figure 1:
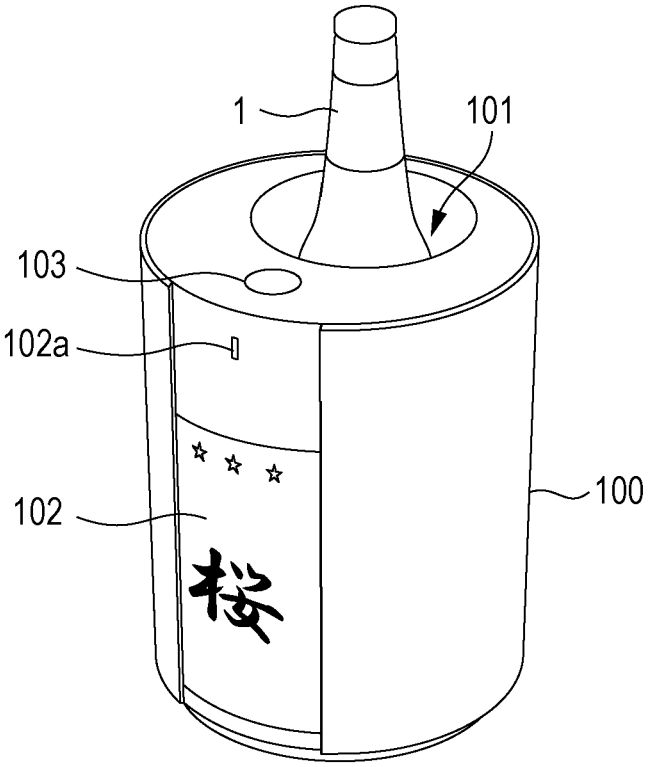
FIG. 1 is a perspective view of an external appearance of a bottle storage according to an embodiment.

FIG. 1 is a perspective view of an external appearance of a bottle storage 100 according to an embodiment. Note that the bottle storage 100 according to this embodiment is not limited to a wine bottle but may be used widely as a storage of a bottle containing a beverage such as champagne or sake.

The bottle storage 100 has a substantially cylindrical shape. Inside the bottle storage 100, a container 101 including a space for containing a bottle 1 is provided. On a side surface of the bottle storage 100, as an example of a presenter, a display 102 including a liquid crystal display or the like and a notifier 102*a* including a light emitting diode (LED) or the like are provided. On a top surface of the bottle storage 100, an operation input 103 including an electrostatic button or the like is provided.

Figure 2:
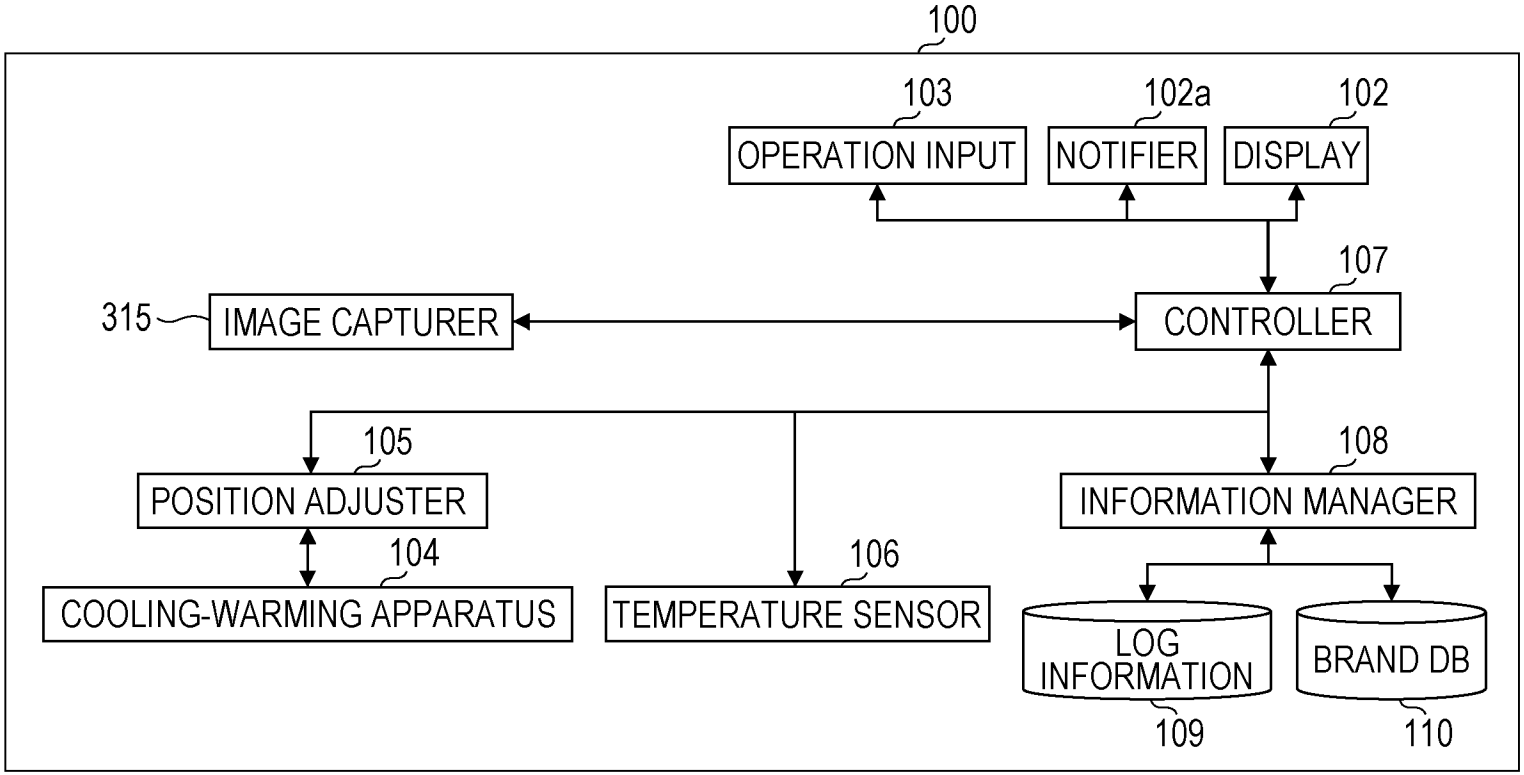
FIG. 2 is a block diagram illustrating a functional configuration of the bottle storage.

FIG. 2 is a block diagram illustrating a functional configuration of the bottle storage 100. The bottle storage 100 includes, in addition to the display 102, the notifier 102*a*, and the operation input 103, a cooling-warming apparatus 104, a position adjuster 105, a temperature sensor 106, a controller 107, an information manager 108, a log information storage (log information) 109, a brand database (brand DB) 110, and an image capturer 315.

The controller 107 controls the overall operation of the bottle storage 100. The cooling-warming apparatus 104 has a function of cooling or warming the bottle 1 inserted into the bottle storage 100. The position adjuster 105 adjusts the position of the cooling-warming apparatus 104 to adjust the temperature of the bottle 1. The temperature sensor 106 measures the temperature of the bottle 1 or the ambient temperature thereof.

The log information storage 109 stores, for example, an operation log, a log about the brand of the bottle 1 that is inserted, and the like.

The brand database 110 stores, for example, a large number of brand label images. In accordance with a user operation through the operation input 103, by using the image capturer 315, the controller 107 and the information manager 108 can read the label of the bottle 1 that is inserted and can retrieve a label image corresponding to the read label from the brand database 110 to be displayed on the display 102. In addition, if the brand database 110 stores other information about the large number of brands, information about the bottle 1 that is inserted (e.g., information about a maker of the beverage and information about its taste) can be retrieved from the brand database 110 to be displayed on the display 102.

Figure 3A:
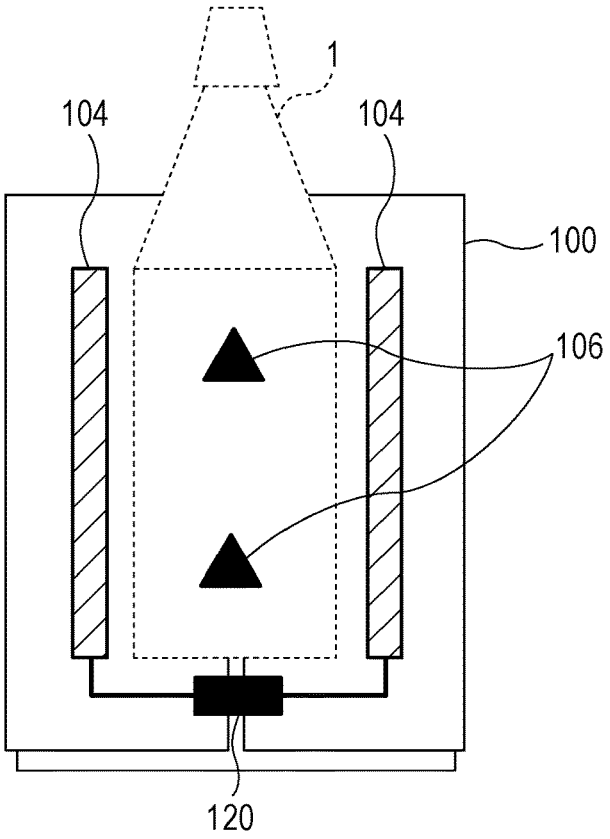
FIG. 3A illustrates a configuration in which a Peltier device is provided in a cooling-warming apparatus and in which cooling-warming control is performed.

FIGS. 3A to 3D are schematic diagrams for describing an example of a cooling-warming operation of the cooling-warming apparatus 104. FIG. 3A illustrates a configuration in which a Peltier device is provided in the cooling-warming apparatus 104 and in which a cooling-warming-apparatus controller 120 electrically performs cooling-warming control of the cooling-warming apparatus 104 in accordance with a temperature measured by the temperature sensor 106.

Figure 3B:
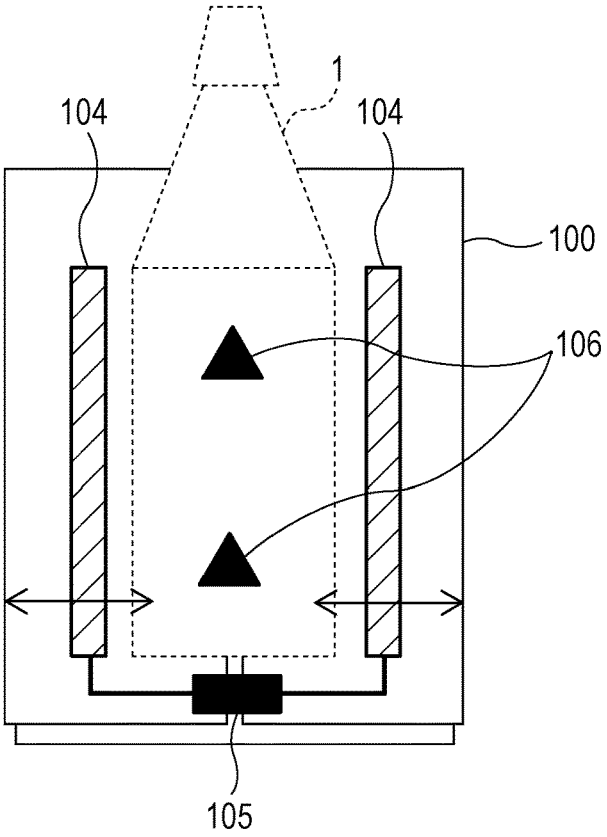
FIG. 3B illustrates a configuration that performs cooling-warming control by changing a physical distance of the cooling-warming apparatus to a bottle.
Figure 3C:
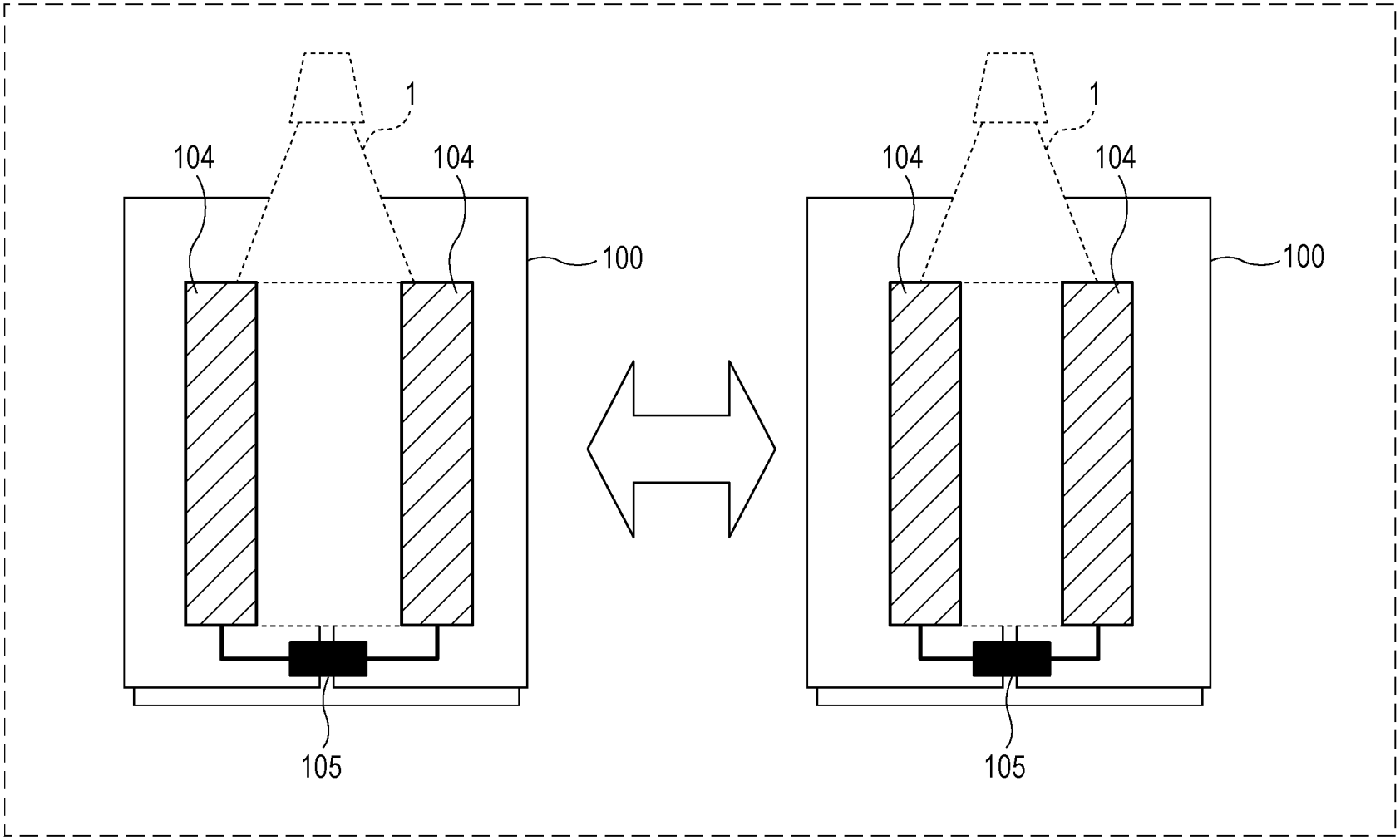
FIG. 3C illustrates a front view of the cooling-warming apparatus that is movable.

On the other hand, FIG. 3B illustrates a cooling-warming configuration corresponding to the functional configuration illustrated in FIG. 2, and FIG. 3C illustrates a front view of the cooling-warming apparatus 104, illustrating an example of adjusting the position of the cooling-warming apparatus 104. As illustrated in FIGS. 3B and 3C, a motor or the like is provided as the position adjuster 105 in the bottle storage 100, and the physical distance of the cooling-warming apparatus 104 to the bottle 1 is changed in accordance with the temperature measured by the temperature sensor 106, and thus, cooling-warming control is performed. For example, if the measured temperature is higher than a target temperature, the cooling-warming apparatus 104 is moved to be close to a bottle containing position; if the measured temperature is lower than or equal to the target temperature, the cooling-warming apparatus 104 is moved to be distant from the bottle containing position.

Figure 3D:
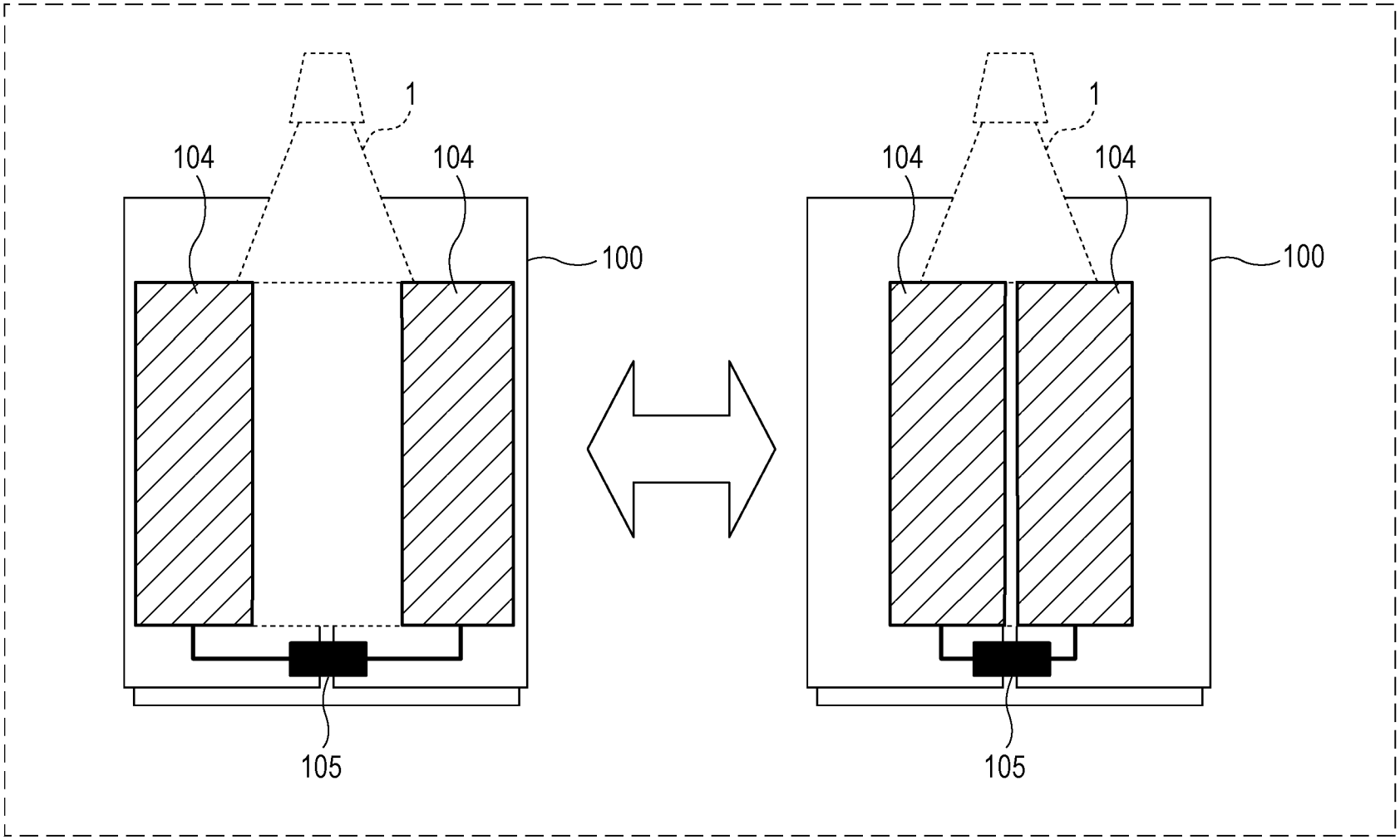
FIG. 3D is a front view of the cooling-warming apparatus that is movable in another example.

Note that, in the cooling-warming apparatus 104 including a Peltier device, the position of the Peltier device may be adjusted. In addition, the cooling-warming apparatus 104 and a gap may have different shapes. FIG. 3D is a front view of the cooling-warming apparatus 104 that is movable in another example. For example, as illustrated in FIG. 3D, the cooling-warming apparatus 104 may have a shape in which the gap disappears when the cooling-warming apparatus 104 is moved to be close to the bottle containing position. Note that the gap may completely disappear, or a gap of a predetermined distance may remain.

Figure 4:
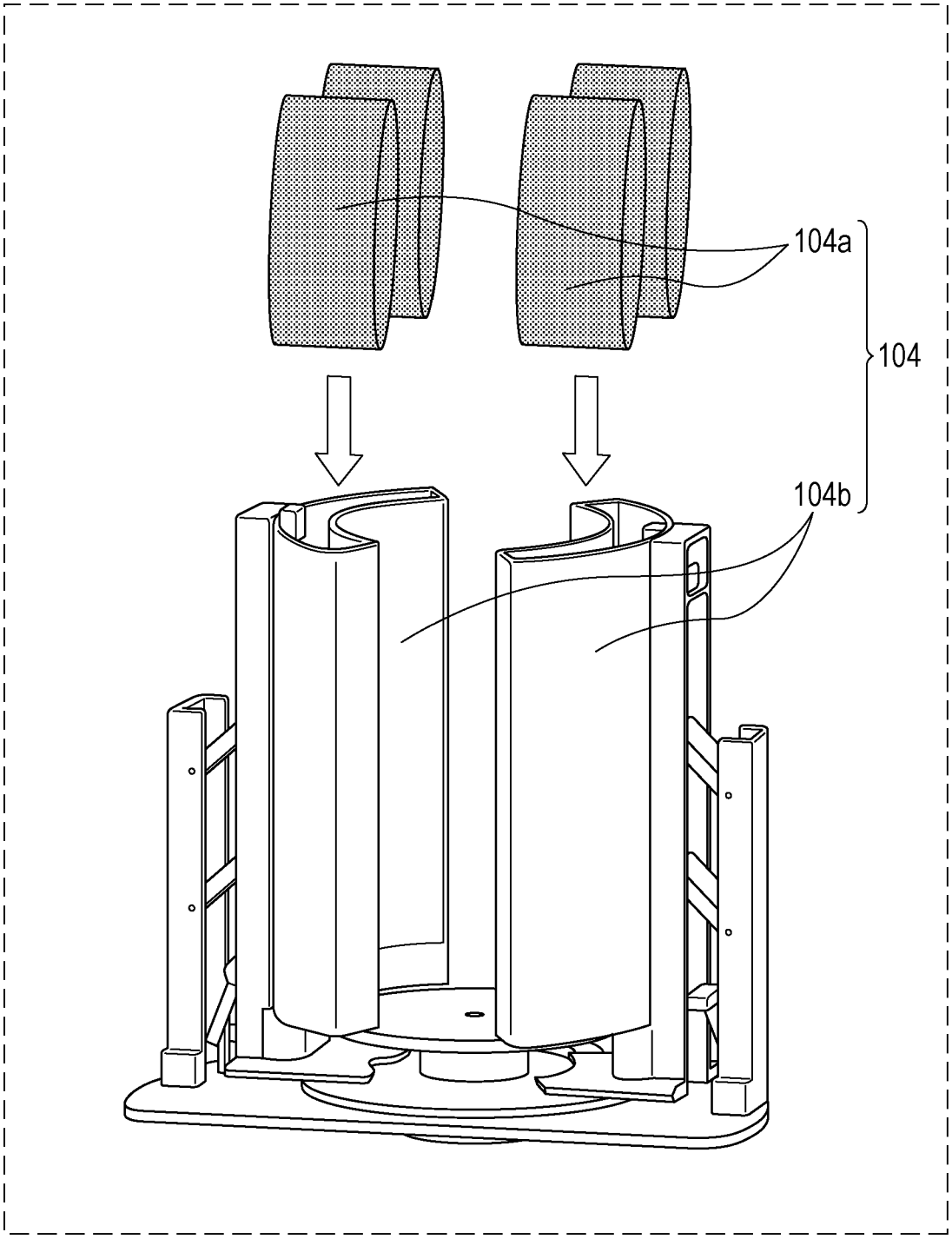
FIG. 4 illustrates the configuration in FIG. 3B in more detail.

FIG. 4 illustrates the configuration in FIG. 3B in more detail. The cooling-warming apparatus 104 includes a cooling-warming medium 104*a* that is cooled or warmed outside in advance and a case 104*b* that contains the cooling-warming medium 104*a*. The cooling-warming apparatus 104 is disposed around the container 101 for the bottle. In addition, the case 104*b*, that is, the cooling-warming apparatus 104, has gaps. For example, as illustrated in FIG. 4, the cooling-warming apparatus 104 has a shape obtained from cutting off some parts in the vertical direction from a cylinder. The gaps change its size in accordance with the adjustment of the position of the cooling-warming apparatus 104. For example, as illustrated in FIG. 3C, the gaps become small as the cooling-warming apparatus 104 is moved to be close to the bottle containing position, and become large as the cooling-warming apparatus 104 is moved to be distant from the bottle containing position.

Note that a cross-section of the cooling-warming apparatus 104 may have a polygonal shape instead of a circular shape. In addition, the number of gaps is not limited to two but may also be three or more.

Furthermore, the gaps do not have to be physical gaps. For example, the case 104*b* may be formed of a material that transmits light, and a gap for image capturing may be provided by not disposing the cooling-warming medium 104*a*.

Figure 5:
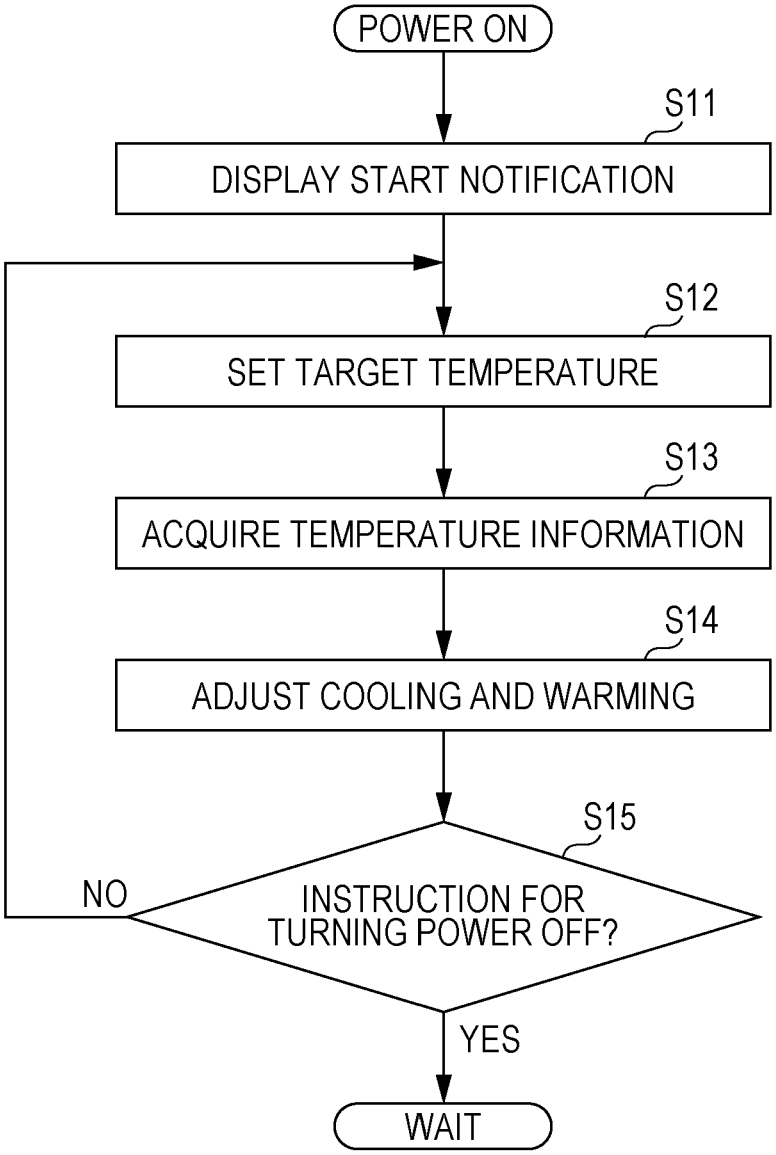
FIG. 5 is a flowchart illustrating a fundamental flow for temperature adjustment.

FIG. 5 is a flowchart illustrating a fundamental flow for temperature adjustment. Upon the power being turned on, in step S11, the controller 107 of the bottle storage 100, for example, causes the LED of the notifier 102*a* to be lit in a predetermined color, thereby displaying a starting notification. In step S12, the controller 107 sets a target temperature. In step S13, the controller 107 acquires temperature information from the temperature sensor 106. In step S14, the controller 107 performs cooling-warning adjustment by controlling the cooling-warming apparatus 104 in such a manner that the measured temperature approaches the target temperature. The cooling-warming adjustment is performed by controlling current flowing to the Peltier device in a case of the configuration of FIG. 3A and by adjusting the position of the cooling-warming apparatus 104 in a case of the configuration of FIG. 3B. The controller 107 repeats the process in steps S12, S13, S14, S15, and S12 until it is determined that the power is turned off in step S15.

<2> Air Blow Function

Figure 6:
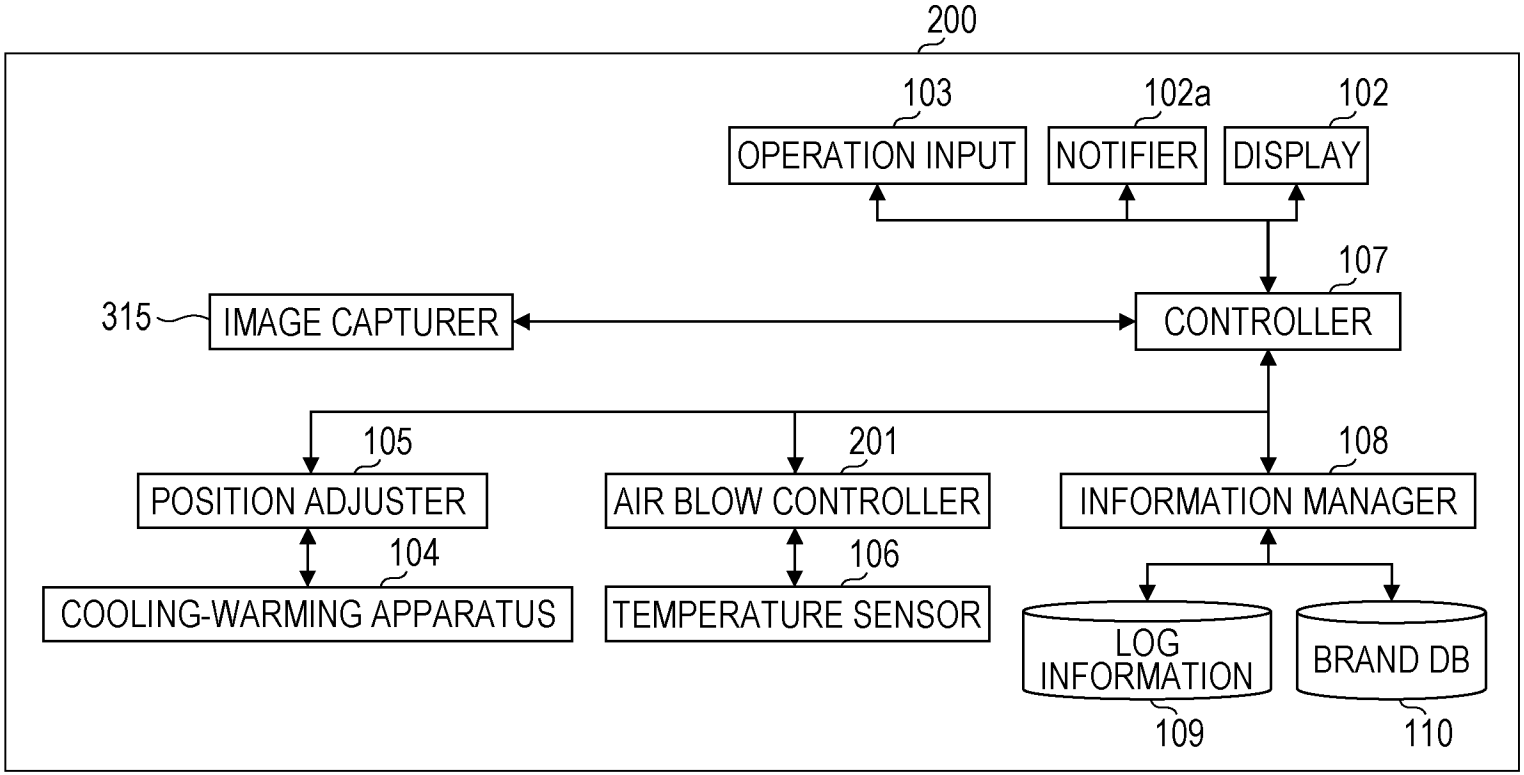
FIG. 6 is a block diagram illustrating a functional configuration of a bottle storage having an air blow function.

FIG. 6 in which components corresponding to those in FIG. 2 are denoted by the same reference numerals is a block diagram illustrating a functional configuration of a bottle storage 200 having an air blow function. The bottle storage 200 includes, in addition to the configuration of the bottle storage 100 in FIG. 2, an air blow controller 201. The air blow controller 201 controls an air blow mechanism in accordance with the temperature measured by the temperature sensor 106. Thus, the bottle storage 200 controls the temperature not only by adjusting the position of the cooling-warming apparatus, but also by using air blow, and accordingly can set the bottle 1 at the desired temperature more immediately or delicately.

Figure 7:
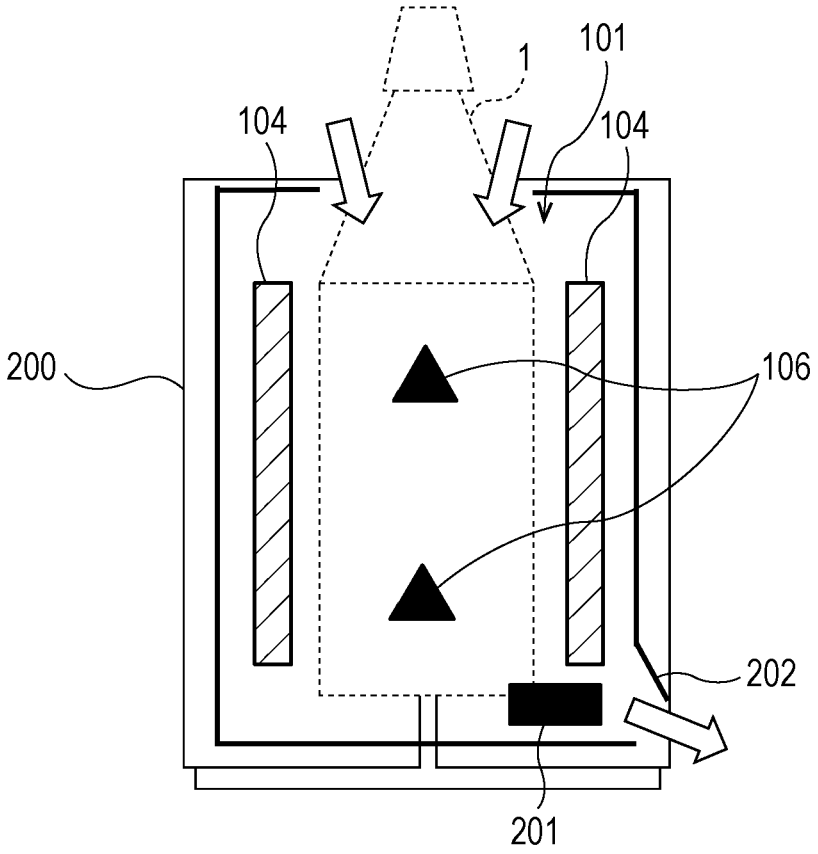
FIG. 7 is a schematic diagram illustrating a configuration of an air blow mechanism of the bottle storage.

FIG. 7 in which components corresponding to those in FIGS. 3A to 3D are denoted by the same reference numerals is a schematic diagram illustrating a configuration of the air blow mechanism of the bottle storage 200. An opening for inserting the bottle 1 is formed in an upper part of the container 101 that contains the bottle 1. In addition, an opening-closing door 202 is provided in a bottom end part of the container 101, and the air blow controller 201 controls the opening and closing of the opening-closing door 202. For example, while the bottle 1 is cooled, the air blow controller 201 sets the opening-closing door 202 in a closed state to decrease the temperature inside the container 101, but when the bottle 1 becomes too cold, the air blow controller 201 sets the opening-closing door 202 in an open state to discharge a cool air to the outside.

Note that in addition to or in place of the opening-closing door 202, an air blow fan may be provided, and the temperature may be adjusted by using the air blow fan. For example, during cooling, the air blow fan may be rotated with the opening-closing door 202 closed so as to perform quick cooling, and when it becomes too cold, the air blow fan may be rotated with the opening-closing door 202 open so as to quickly increase the temperature.

<3> Cooling Facilitating Function

Figure 8:
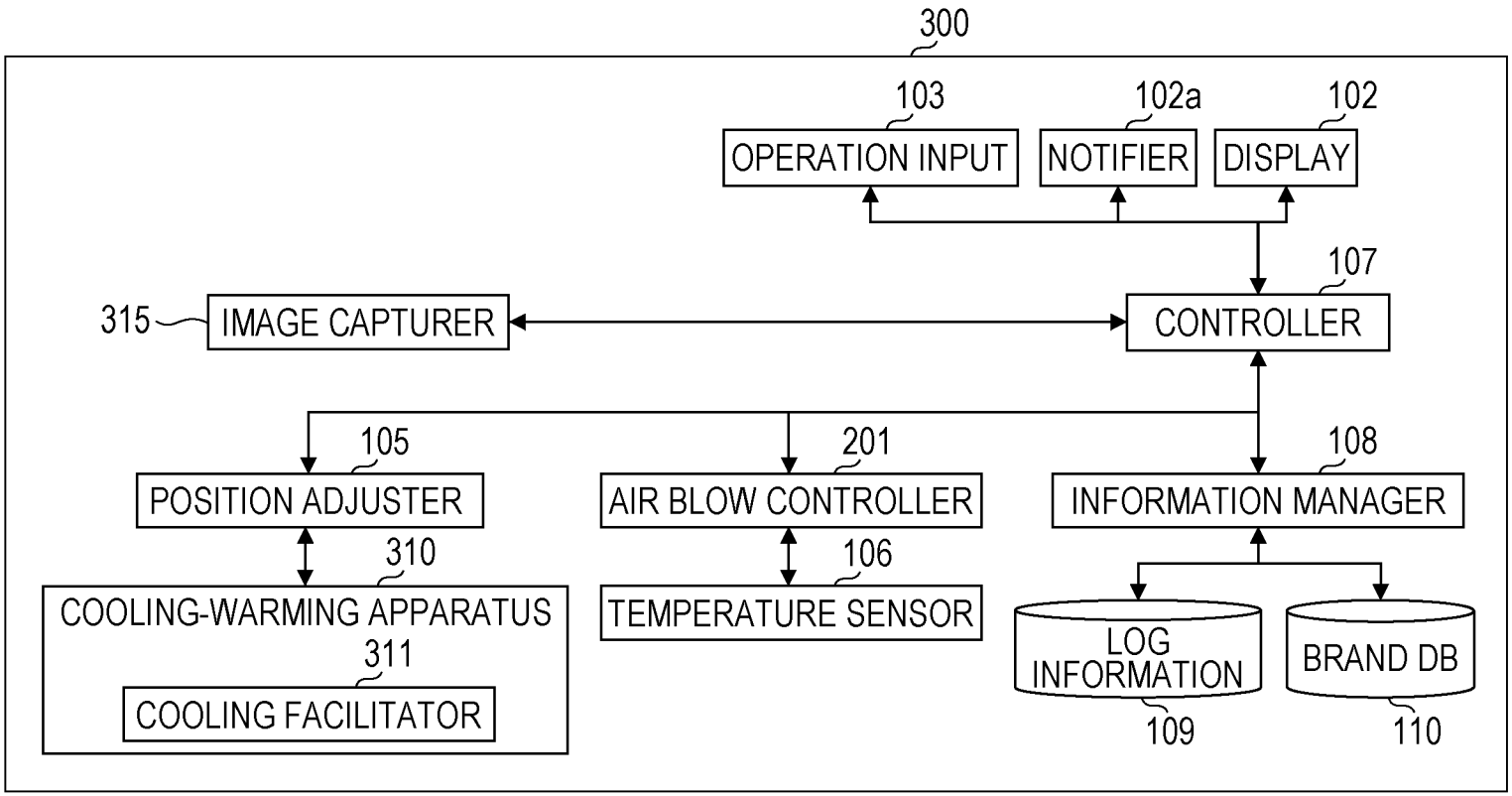
FIG. 8 is a block diagram illustrating a functional configuration of a bottle storage having a cooling facilitating function.

FIG. 8 in which components corresponding to those in FIG. 6 are denoted by the same reference numerals is a block diagram illustrating a functional configuration of a bottle storage 300 having a cooling facilitating function. The bottle storage 300 differs from the bottle storage 200 in a configuration of a cooling-warming apparatus 310. The cooling-warming apparatus 310 includes a cooling facilitator 311.

Figure 9A:
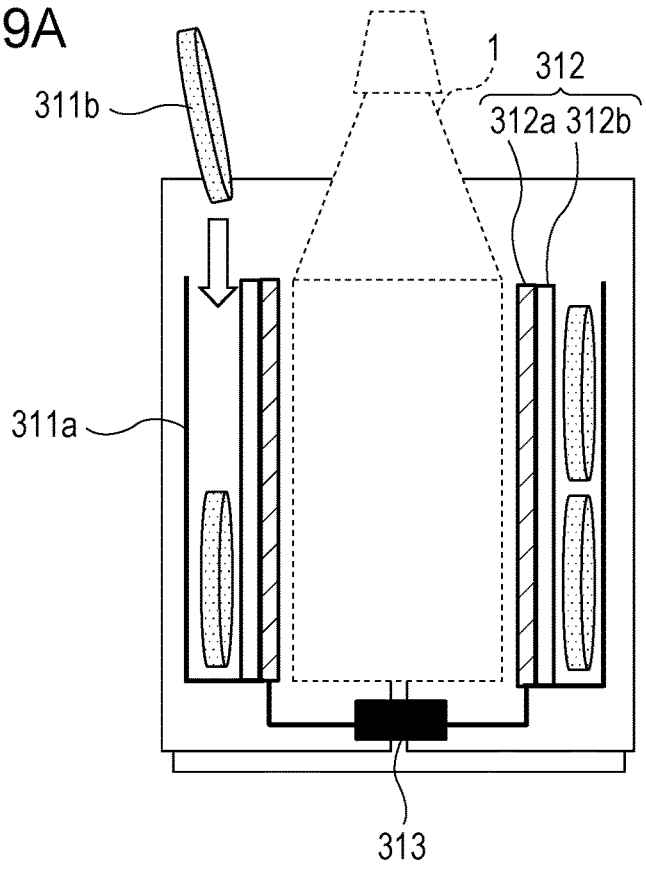
FIG. 9A is a schematic diagram of a cooling-warming apparatus having a cooling facilitating function as seen from the side-surface direction.
Figure 9B:
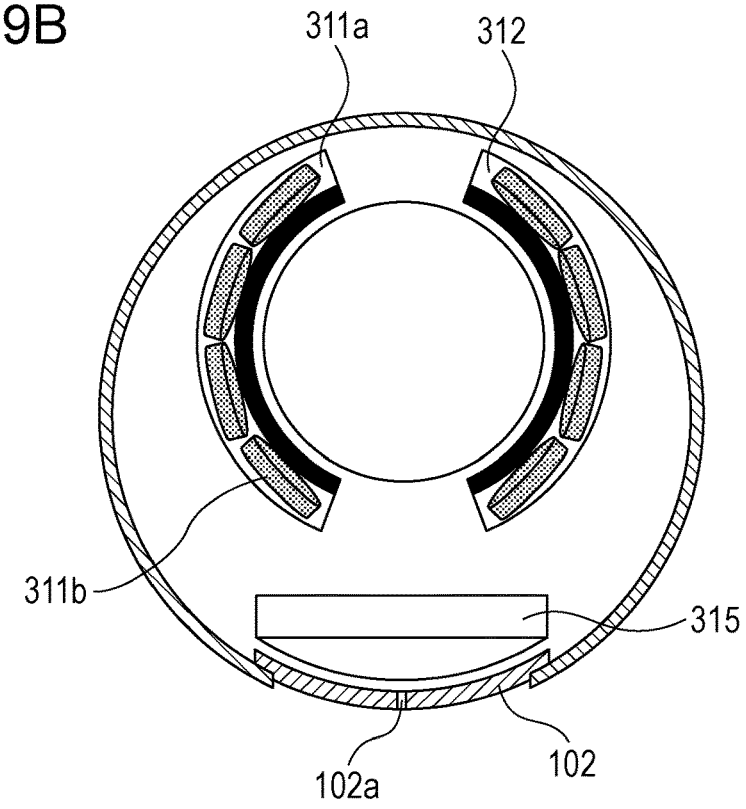
FIG. 9B is a schematic diagram of the cooling-warming apparatus having a cooling facilitating function as seen from the above direction.

FIGS. 9A and 9B are schematic diagrams illustrating a configuration of the cooling-warming apparatus 310. FIG. 9A illustrates the cooling-warming apparatus 310 as seen from the side-surface direction of the bottle storage 300, and FIG. 9B illustrates the cooling-warming apparatus 310 as seen from the above direction of the bottle storage 300. The cooling-warming apparatus 310 includes a Peltier device 312, a cooling-warming-apparatus controller 313, and the cooling facilitator 311. Note that the position adjuster 105, the air blow controller 201, and the like are omitted in FIGS. 9A and 9B for simplicity of the drawings.

The Peltier device 312 is disposed such that a cooling surface 312*a* faces the bottle 1 and a heat generating surface 312*b* faces away from the bottle 1. The cooling-warming-apparatus controller 313 controls current flowing to the Peltier device 312 so as to control a cooling operation of the Peltier device 312.

The cooling facilitator 311 includes a container 311*a* provided on the heat generating surface 312*b* side of the Peltier device 312 and a coolant 311*b* stored in the container 311*a*. The coolant 311*b* may be referred to as a regenerating agent or a refrigerant and is cooled at, for example, 0° C. or less in advance by using another cooling-warming apparatus or the like.

The cooling-warming apparatus 310 according to this embodiment is configured such that the heat generating surface 312*b* of the Peltier device 312 is cooled with the coolant 311*b*, and accordingly, noise is eliminated compared with a case in which the heat generating surface 312*b* of the Peltier device 312 is cooled by airflow of a fan or the like. In particular, since it is assumed that the bottle storage according to this embodiment is used at tables, noise generated by a fan may be annoying. However, the configuration illustrated in FIGS. 9A and 9B does not generate noise caused by a fan, and thus, tranquility can be maintained during the meal or conversation.

As found from FIG. 9B, the Peltier device 312 and the cooling facilitator 311 are disposed around the bottle 1 so as to surround the bottle 1. In addition, as illustrated in FIG. 9B, the image capturer 315 for capturing an image of the label of the bottle 1 is provided, and the gaps of the cooling-warming apparatus 310 correspond to at least a part of an image capturing region of the image capturer 315. For example, in FIG. 9B, a gap of the cooling-warming apparatus 310 is provided in front of the image capturer 315.

In addition, although the size of the gaps of the cooling-warming apparatus 310 changes in accordance with the movement of the cooling-warming apparatus 310 as in the cooling-warming apparatus 104, both the image capturing of the image capturer 315 and cooling can be achieved. For example, if image capturing takes priority, as illustrated in FIG. 3C, the cooling-warming apparatus 310 has gaps such that the bottle is included in the image capturing region of the image capturer 315 in the state in which the cooling-warming apparatus 310 is moved to be closer to the bottle containing position. On the other hand, if cooling takes priority, as illustrated in FIG. 3D, the cooling-warming apparatus 310 has gaps such that the bottle is not included in the image capturing region of the image capturer 315 in the state in which the cooling-warming apparatus 310 is moved to be closer to the bottle containing position.

In addition, the image capturer 315 and the cooling-warming apparatus 310 are disposed to be distant from each other. For example, in FIG. 9B, the cooling-warming apparatus 310 is disposed such that the center of the cooling-warming apparatus 310 is more distant from the image capturer 315 than the center of the bottle storage 300.

In addition, the display 102 is provided to be adjacent to the image capturer 315. The display 102 displays an image based on a captured image obtained by image capturing of the image capturer 315.

<4> Liquid Temperature Detecting Function Using Communication

Figure 10:
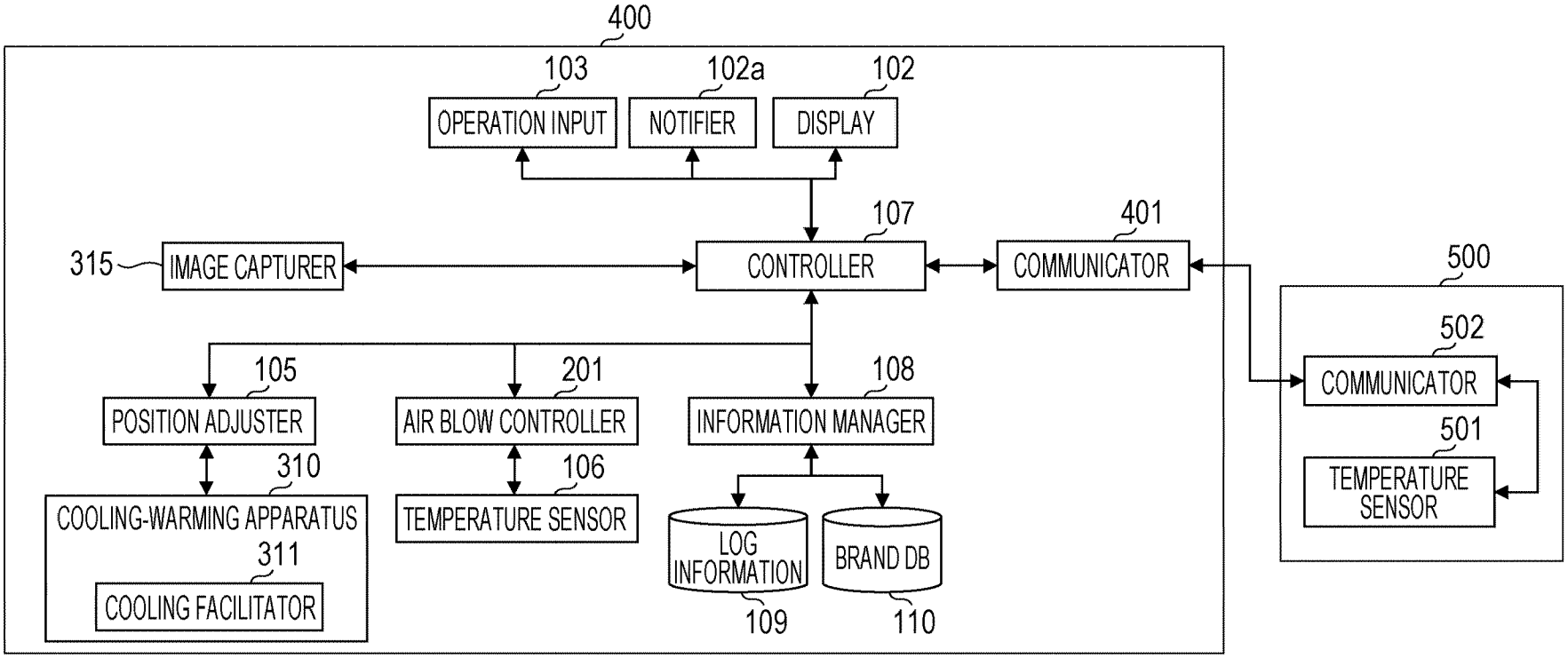
FIG. 10 is a block diagram illustrating functional configurations of a bottle storage having a liquid temperature detecting function using communication and a bottle cap device.

FIG. 10 in which components corresponding to those in FIG. 8 are denoted by the same reference numerals is a block diagram illustrating functional configurations of a bottle storage 400 having a liquid temperature detecting function using communication and a bottle cap device 500. The bottle storage 400 includes a communicator 401 that can perform communication with the bottle cap device 500. The bottle cap device 500 includes a temperature sensor 501 and a communicator 502.

Figure 11A:
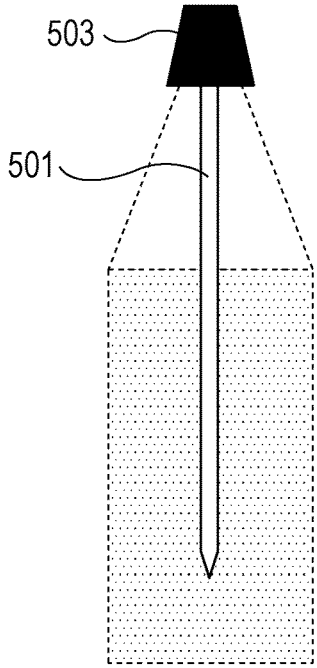
FIG. 11A illustrates a configuration example for detecting and transmitting a liquid temperature by using the bottle cap device and illustrates a state in which the bottle cap device is mounted on a bottle.
Figure 11B:
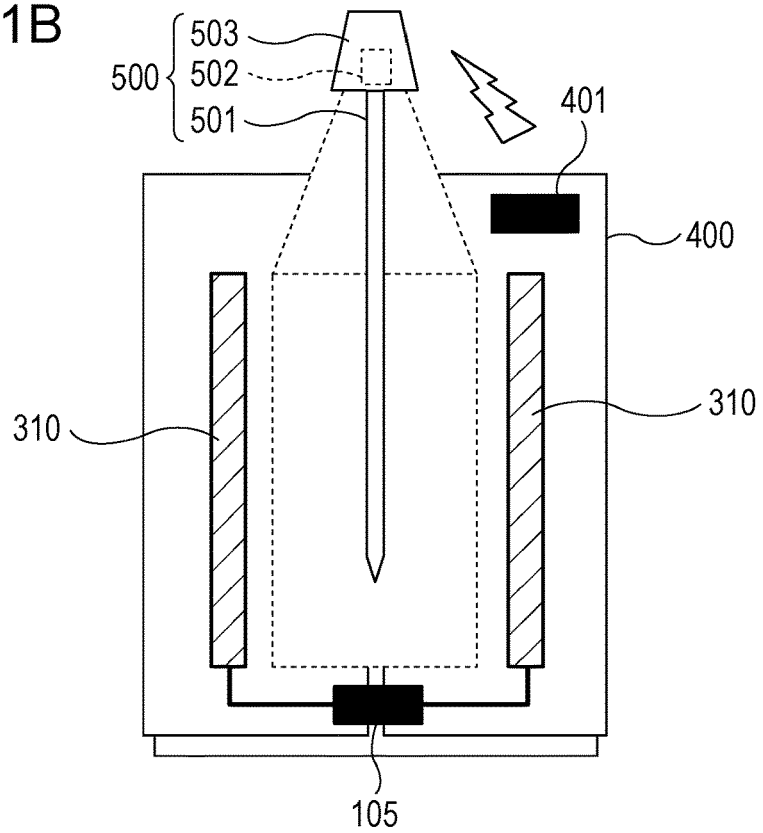
FIG. 11B illustrates a configuration example for detecting and transmitting a liquid temperature by using the bottle cap device and illustrates a state of communication between the bottle cap device and the bottle storage.

FIGS. 11A and 11B illustrate configuration examples for detecting and transmitting a liquid temperature by using the bottle cap device 500. FIG. 11A illustrates a state in which the bottle cap device 500 is mounted on the bottle 1. The bottle cap device 500 includes the temperature sensor (probe) 501 that extends downward from a cap main body 503. In addition, the cap main body 503 includes the communicator 502. FIG. 11B is a schematic diagram illustrating a state of communication between the bottle cap device 500 and the bottle storage 400. Temperature information measured by the temperature sensor 501 is transmitted from the communicator 502 to the communicator 401 of the bottle storage 400 by wireless communication.

In accordance with the temperature information received from the bottle cap device 500, the controller 107 of the bottle storage 400 controls the cooling-warming apparatus 310, the position adjuster 105, and/or the air blow controller 201 to adjust the temperature. Thus, the temperature of the beverage is directly measured, and the temperature can be adjusted in a preferred manner compared with a case in which the temperature is adjusted in accordance with the temperature outside the bottle 1 by using the temperature sensor 106.

<5> Weight Detecting Function

Figure 12:
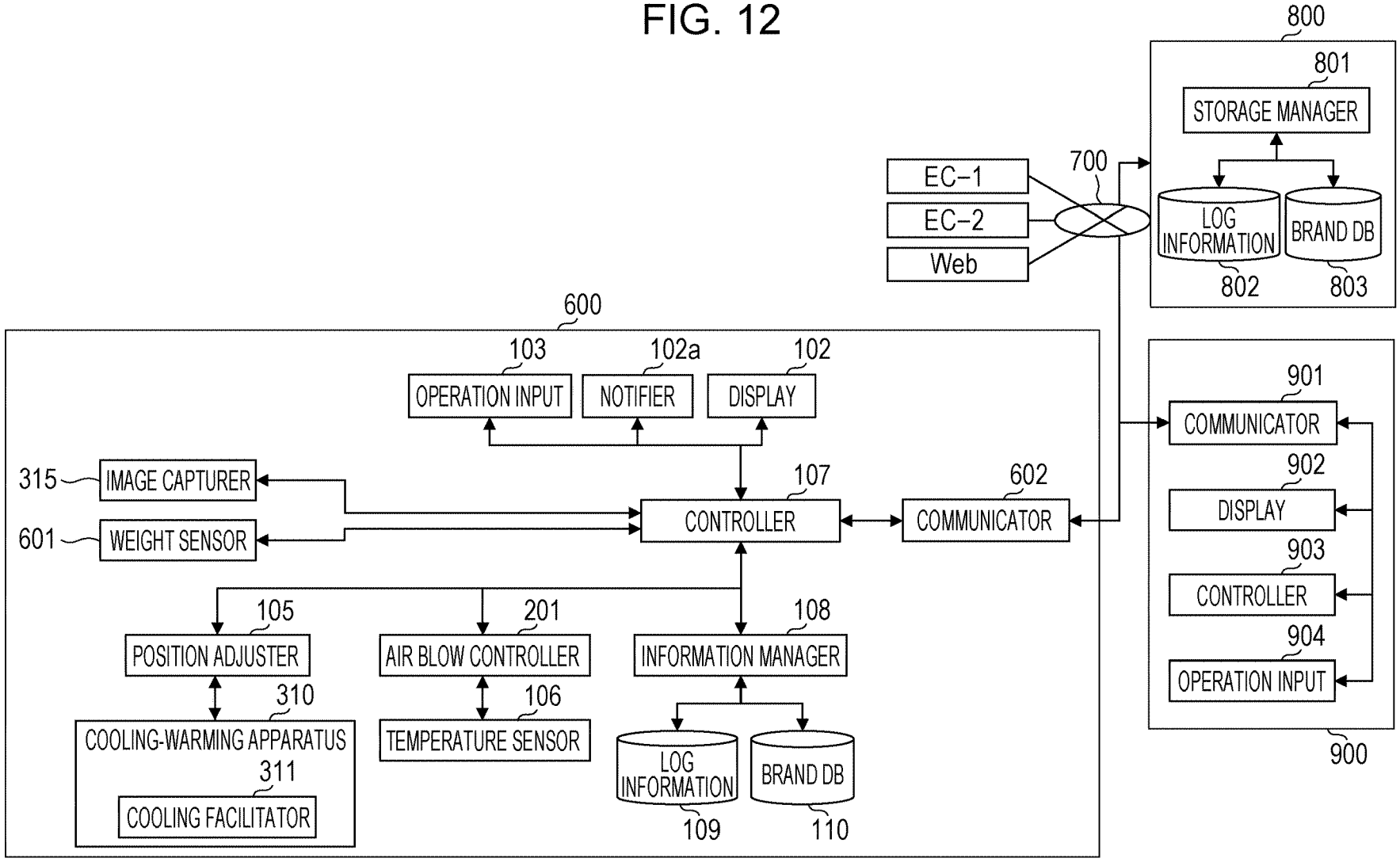
FIG. 12 is a block diagram illustrating functional configurations of a bottle storage having a weight detecting function and a system using the bottle storage.

FIG. 12 in which components corresponding to those in FIG. 8 are denoted by the same reference numerals is a block diagram illustrating functional configurations of a bottle storage 600 having a weight detecting function and a system using the bottle storage 600. The bottle storage 600 includes a weight sensor 601 and a communicator 602. The communicator 602 can perform communication with a cloud server 800 via an Internet 700. In addition, the communicator 602 can perform communication with an information apparatus 900 via the Internet 700 or directly. Thus, weight information obtained by the weight sensor 601 can be transmitted to the cloud server 800 or the information apparatus 900.

The cloud server 800 includes a storage manager 801, a log information storage 802, and a brand database 803. The cloud server 800 can perform communication with a plurality of bottle storages 600, log information of the plurality of bottle storages 600 can be recorded in the log information storage 802, and a considerably large number of brand data items can be stored in the brand database 803. The information apparatus 900 is, for example, a smartphone or the like, and includes a communicator 901, a display 902, a controller 903, an operation input 904, and the like.

Figure 13:
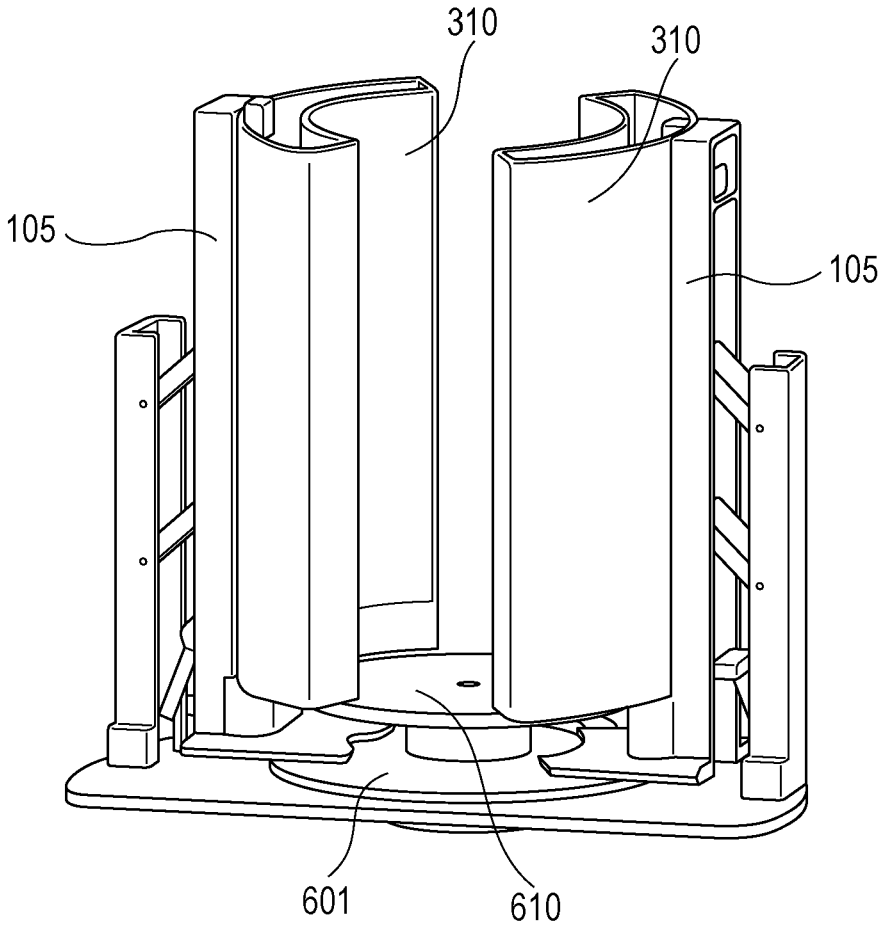
FIG. 13 illustrates a configuration example for measuring a change in the bottle weight by using a weight sensor.

FIG. 13 illustrates a configuration example for measuring a change in the bottle weight by using the weight sensor 601. The bottle storage 600 includes a bottle stand 610 on which the bottle 1 is placed. The weight sensor 601 measures the weight of the bottle 1 placed on the bottle stand 610. The weight sensor 601 measures the weight of the bottle 1 by using a known mechanism, such as a piezoelectric element or a strain gauge.

Note that the cooling-warming apparatus 310 is held by the position adjuster 105, and the position adjuster 105 is moved by a moving mechanism, which is not illustrated, including a motor or the like. As a result, the cooling-warming apparatus 310 is configured to be movable to be close to or distant from the bottle 1.

Weight information obtained by the weight sensor 601 is stored in the log information storage 109 of the bottle storage 600 or the log information storage 802 of the cloud server 800. FIG. 14 illustrates an example of a weight history log stored in the log information storage 109 and the log information storage 802. The weight information is stored in association with the date, time, and a content identifier (CID).

The content ID is an ID for identifying the bottle (thus, the content ID may be referred to as a bottle ID). For example, a user inputs information for identifying the bottle 1 by using the operation input 103 when inserting the bottle 1 into the bottle storage 600.

Note that in a case of a bottle storage including an image capturer such as a camera, the image capturer captures an image of a label of the bottle, and the information manager 108 checks the captured image against an image stored in the brand database 110 so that the content ID can be identified.

The weight stored as the weight history log may be the weight of the beverage excluding the weight of the bottle as illustrated in the example in FIG. 14 or may be the total weight including the weight of the bottle. However, the remaining amount of the beverage can be obtained if the weight of the beverage is known, and accordingly, it is preferred to store the weight history log of the beverage excluding the weight of the bottle. Note that the weight of the bottle can be obtained as long as the content ID can be identified, and accordingly, by subtracting the weight of the bottle from the total weight, the weight of the beverage can be easily calculated.

In a case in which the bottle storage 600 is used at a restaurant, for example, a user such as a server can know from the information apparatus 900, the remaining amount of the beverage in the bottle 1 currently inserted into the bottle storage 600. If the remaining amount becomes small, the user can prepare the next bottle 1. For example, as illustrated in the example in FIG. 14, when the weight becomes "70", the server can know the small remaining amount and can take the next order at the table where the bottle storage 600 is placed. Thus, the service quality can be increased.

<6> Liquid Amount Detecting Function Using Bottle Cap

Figure 15:
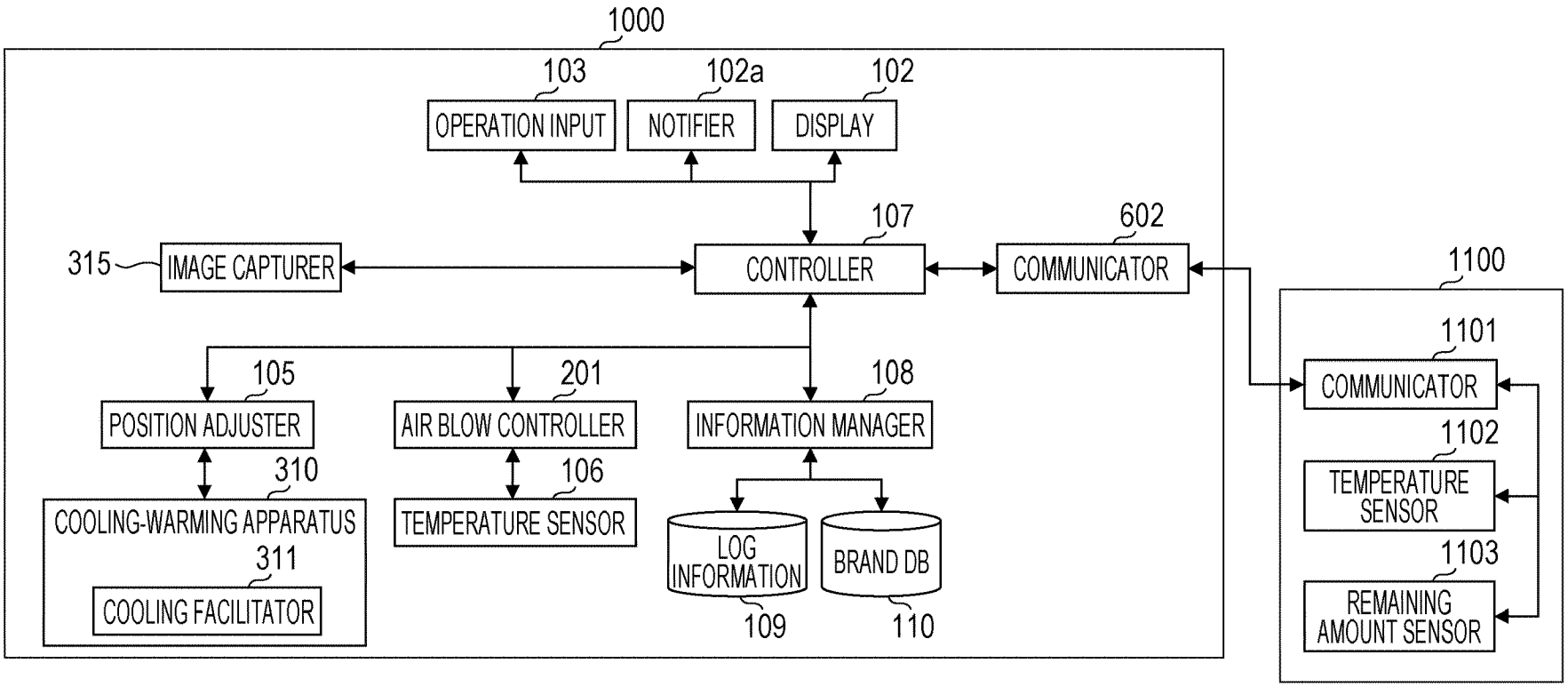
FIG. 15 is a block diagram illustrating functional configurations of a bottle storage having a liquid amount detecting function using a bottle cap device and the bottle cap device.

FIG. 15 in which components corresponding to those in FIG. 12 are denoted by the same reference numerals is a block diagram illustrating functional configurations of a bottle storage 1000 having a liquid amount (or remaining amount) detecting function using a bottle cap device 1100 and the bottle cap device 1100. The bottle cap device 1100 includes a communicator 1101, a temperature sensor 1102, and a remaining amount sensor 1103. The communicator 602 and the communicator 1101 can perform wireless communication with each other. Temperature information and remaining amount information about the beverage obtained by the bottle cap device 1100 are transmitted to the bottle storage 1000 by wireless communication.

Figure 16A:
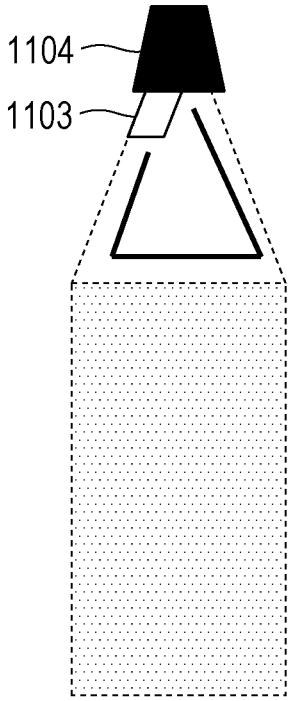
FIG. 16A illustrates an example of detecting the amount of a beverage by using the bottle cap device.
Figure 16B:
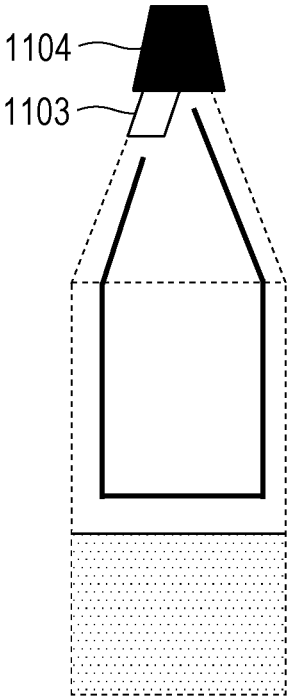
FIG. 16B illustrates an example of detecting the amount of a beverage by using the bottle cap device.

FIGS. 16A and 16B illustrate examples of detecting the amount of the beverage by using the bottle cap device 1100. A cap main body 1104 is equipped with, for example, an electrostatic capacitance sensor as the remaining amount sensor 1103. The electrostatic capacitance sensor detects a change of the surface of a liquid in the vertical direction as a change in electrostatic capacitance, thereby detecting the remaining amount of the beverage. That is, in a case in which the remaining amount is large as illustrated in FIG. 16A, the electrostatic capacitance between the electrostatic capacitance sensor and the surface of the liquid is small; in a case in which the remaining amount is small as illustrated in FIG. 16B, the electrostatic capacitance between the electrostatic capacitance sensor and the surface of the liquid is large. Thus, on the basis of the electrostatic capacitance, the remaining amount can be detected. Note that the temperature sensor 1102 is omitted in FIGS. 16A and 16B for simplicity of the drawings.

Figure 17A:
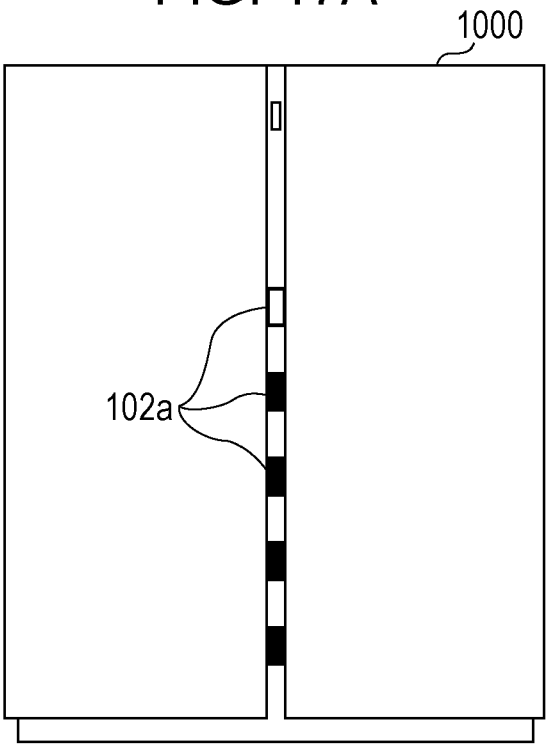
FIG. 17A illustrates an example in which the bottle storage displays a remaining amount.
Figure 17B:
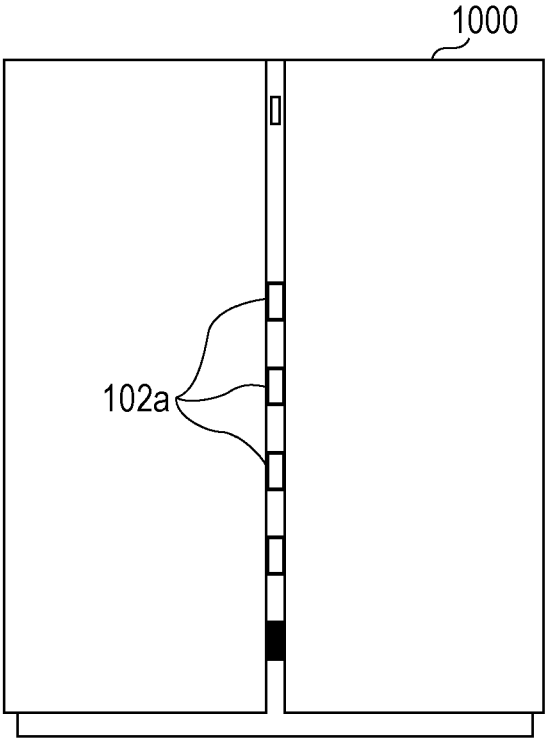
FIG. 17B illustrates an example in which the bottle storage displays a remaining amount.

FIGS. 17A and 17B illustrate examples in which the bottle storage 1000 displays the remaining amount. In the examples in FIGS. 17A and 17B, a plurality of LEDs are provided as the notifier 102*a* of the bottle storage 1000, and by lighting the LEDs of a number corresponding to the remaining amount, the remaining amount is displayed. It is needless to say that, instead of such display, the remaining amount may be displayed on the display 102 as a numerical value. That is, the notifier 102*a* and the display 102 can be used as a remaining amount display. In addition, as in FIG. 12, the remaining amount may be transmitted to the cloud server 800 and the information apparatus 900. In contrast, the remaining amount based on the weight measured by the weight sensor 601 may be displayed by using the LEDs as illustrated in FIGS. 17A and 17B.

In particular, the color of emitted light of a light emitter provided on the surface of the bottle storage 1000 can be switched to another color when the remaining amount becomes smaller than a predetermined threshold, which is convenient because the color of emitted light can inform a user or a server that the beverage in the bottle storage 1000 becomes scarce.

<7> Other Embodiments

<7-1>

An audio input/output may be provided for any of the above-described bottle storages so that various kinds of information may be audibly output. For example, the brand of the bottle inserted into the bottle storage or information about the brand may be audibly output. In addition, in a case in which a sensor that detects the remaining amount of the beverage in the bottle 1 is provided, the audio output may inform a user or a server that the remaining amount of the beverage is small.

Furthermore, the bottle storage may perform interactive communication. For example, in response to a request that is audibly input from the audio input/output, information retrieved from the log information storage 109 or the brand database 110 may be output from the audio input/output.

<7-2>

The configuration in which the Peltier device 312 and the coolant 311*b* that has been cooled outside in advance are provided to cool the heat generating surface 312*b* of the Peltier device 312 with the coolant 311*b*, as illustrated in FIGS. 9A and 9B, can be used for another cooling apparatus other than the bottle storage. This configuration enables the heat generating surface of the Peltier device to be cooled without generating noise and thus is particularly available for a cooling apparatus that is placed in a situation, such as at tables, where tranquility is desired.

<7-3>

Figure 18:
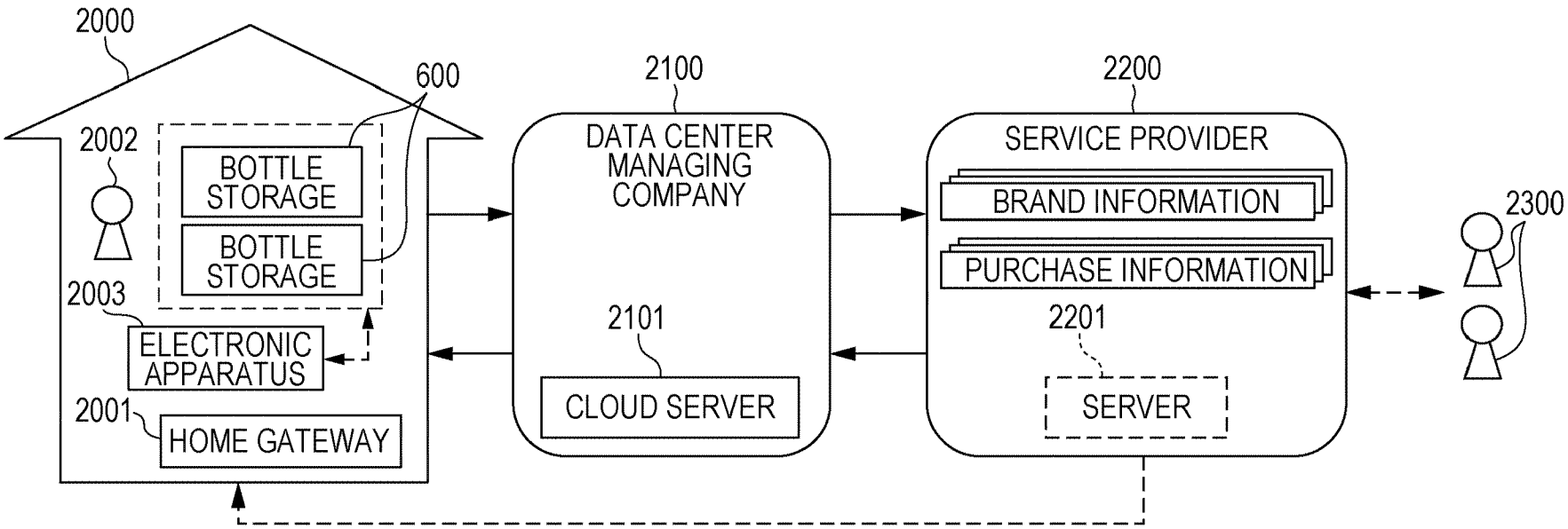
FIG. 18 is a schematic diagram illustrating a specific example of a system including a bottle storage according to an embodiment.

FIG. 18 is a schematic diagram illustrating a specific example of a system including a bottle storage according to an embodiment among the above-described embodiments. Note that any of the bottle storages according to the above-described embodiments may be used as the bottle storage as long as a communicator is provided. In FIG. 18, the bottle storage 600 is used as an example.

A group 2000 is, for example, a company, an organization, a home, or the like, and may be of any scale. The group 2000 includes a plurality of bottle storages 600 and a home gateway 2001. The plurality of bottle storages 600 include one or more bottle storages that are connectable to the Internet and one or more bottle storages that are not connectable to the Internet by themselves. The one or more bottle storages that are not connectable to the Internet by themselves may include one or more bottle storages that are connectable to the Internet via the home gateway 2001. The group 2000 also includes a user 2002 who uses any of the bottle storages 600. The bottle storages 600 may perform communication with an electronic apparatus 2003 such as a smartphone used by the user 2002.

A data center managing company 2100 includes a cloud server 2101. The cloud server 2101 is a virtual server that cooperates with a variety of apparatuses via the Internet and mainly manages big data that is difficult to handle with a normal database management tool or the like. The data center managing company 2100, for example, manages data, the cloud server 2101, and a data center that manages data and the cloud server 2101.

Note that each of the bottle storages 600 may perform communication indirectly with the cloud server 2101 via a personal gateway such as a mobile phone or a wireless communication router. In addition, each of the bottle storages 600 may perform communication directly with the cloud server 2101 without a gateway.

Figure 19A:
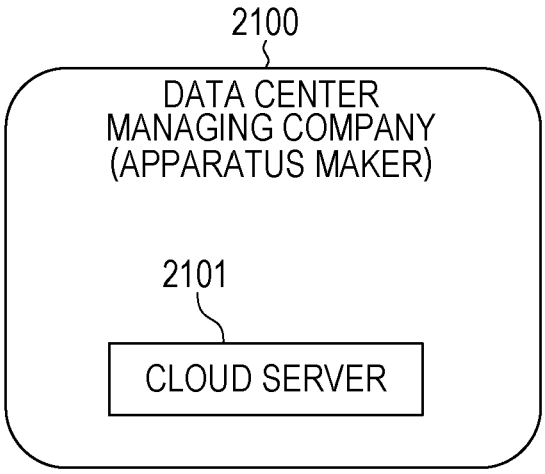
FIG. 19A illustrates an example in which an apparatus maker manages a cloud server.

Note that the data center managing company 2100 is not limited to a company that only manages data, the cloud server 2101, or the like. For example, in some cases, as illustrated in FIG. 19A, an apparatus maker that develops and manufactures one of the plurality of bottle storages 600 also manages data and the cloud server 2101. In those cases, the apparatus maker corresponds to the data center managing company 2100.

Figure 19B:
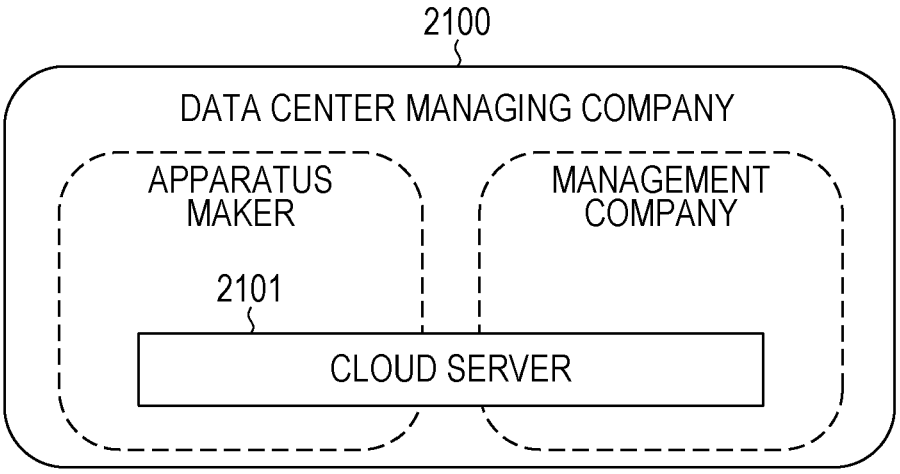
FIG. 19B illustrates an example in which an apparatus maker and a management company manage a cloud server in cooperation with each other or by sharing responsibility.

In addition, the data center managing company 2100 is not limited to a single company. For example, in some cases, as illustrated in FIG. 19B, an apparatus maker and another management company manage data and the cloud server 2101 in cooperation with each other or by sharing responsibility. In those cases, either or both of the apparatus maker and the management company corresponds or correspond to the data center managing company 2100.

A service provider 2200 has a server 2201. The server 2201 here may be of any scale and includes, for example, a memory in a personal computer. In addition, in some cases, the service provider 2200 does not have the server 2201.

Note that the home gateway 2001 is not necessary in the above service. For example, in a case in which the cloud server 2101 manages all data, the home gateway 2001 is unnecessary. In addition, for example, in a case in which various apparatuses at home are connected to the Internet, there are no apparatuses that are not connectable to the Internet by themselves.

Next, an information flow in the above service will be described.

First, each of the bottle storages 600 in the group 2000 transmits log information to the cloud server 2101 of the data center managing company 2100. The cloud server 2101 stores the log information from the bottle storages 600.

In some cases, the plurality of bottle storages 600 directly provide the log information to the cloud server 2101 via the Internet. In addition, the log information from the plurality of bottle storages 600 may be temporarily stored in the home gateway 2001 and may be provided from the home gateway 2001 to the cloud server 2101.

Subsequently, the cloud server 2101 of the data center managing company 2100 provides a certain amount of the stored log information to the service provider 2200. Note that the certain amount may be an amount by which the stored information can be organized by the data center managing company 2100 so as to be provided to the service provider 2200 or an amount requested by the service provider 2200. The certain amount may be variable, and the amount of information to be provided may change in accordance with the situation.

The log information is stored as necessary in the server 2201 that the service provider 2200 has. The service provider 2200 organizes the log information as information that fits a service provided to a user and provides the information to the user. The user may be the user 2002 who uses any of the plurality of bottle storages 600 or a user 2300 who manages the bottle storages 600. The user 2300 is, for example, a manager of a restaurant. Alternatively, the user may be an external user.

For example, the service may be directly provided from the service provider 2200 to the user. Alternatively, for example, the service may be provided to the user via the cloud server 2101 of the data center managing company 2100 again. Further alternatively, the cloud server 2101 of the data center managing company 2100 may organize the log information as information that fits the service provided to the user, and the information may be provided to the service provider 2200.

Note that the user 2002 and the user 2300 may be different users or an identical user.

<7-4>

Figure 20:
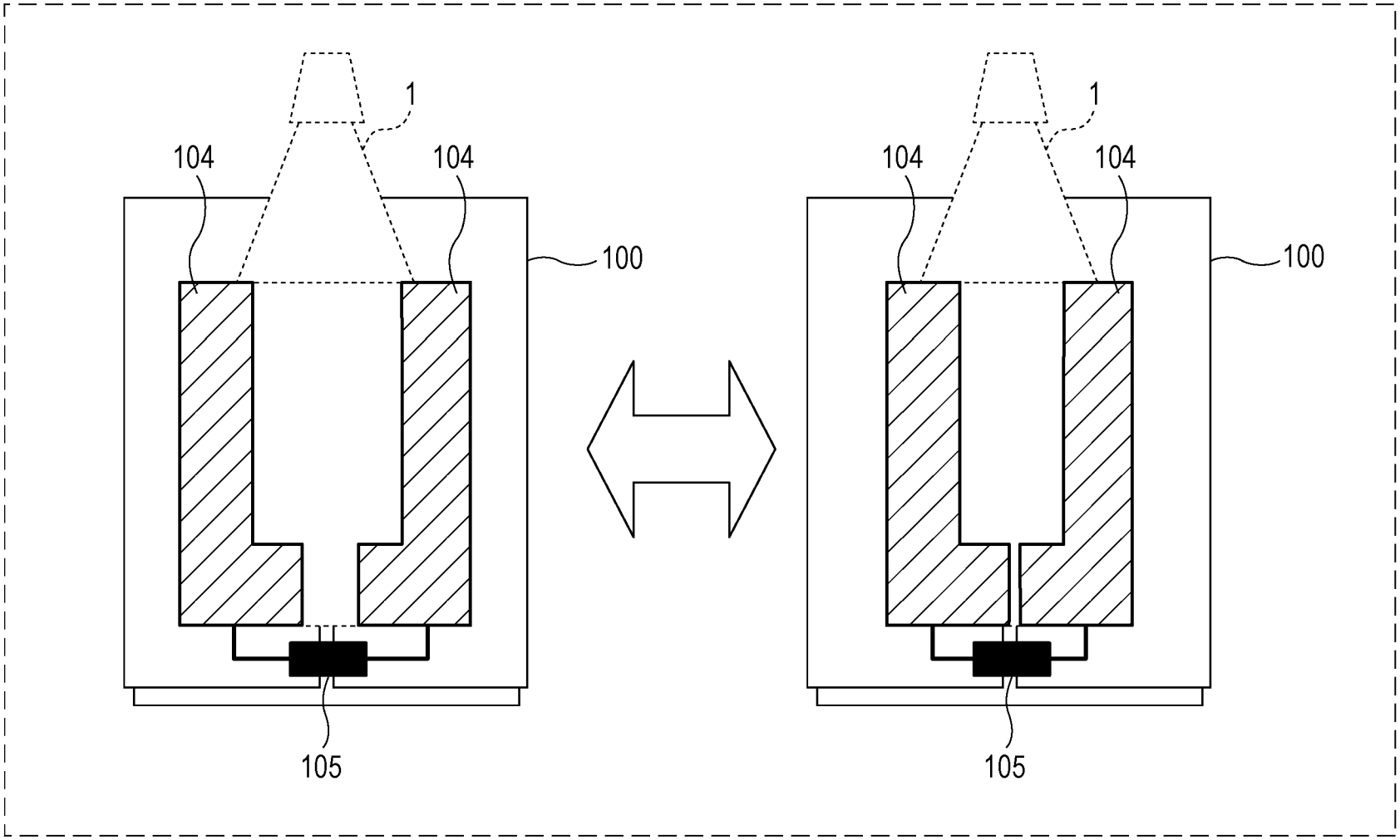
FIG. 20 is a front view of a cooling-warming apparatus that is movable in another example.
Figure 21:
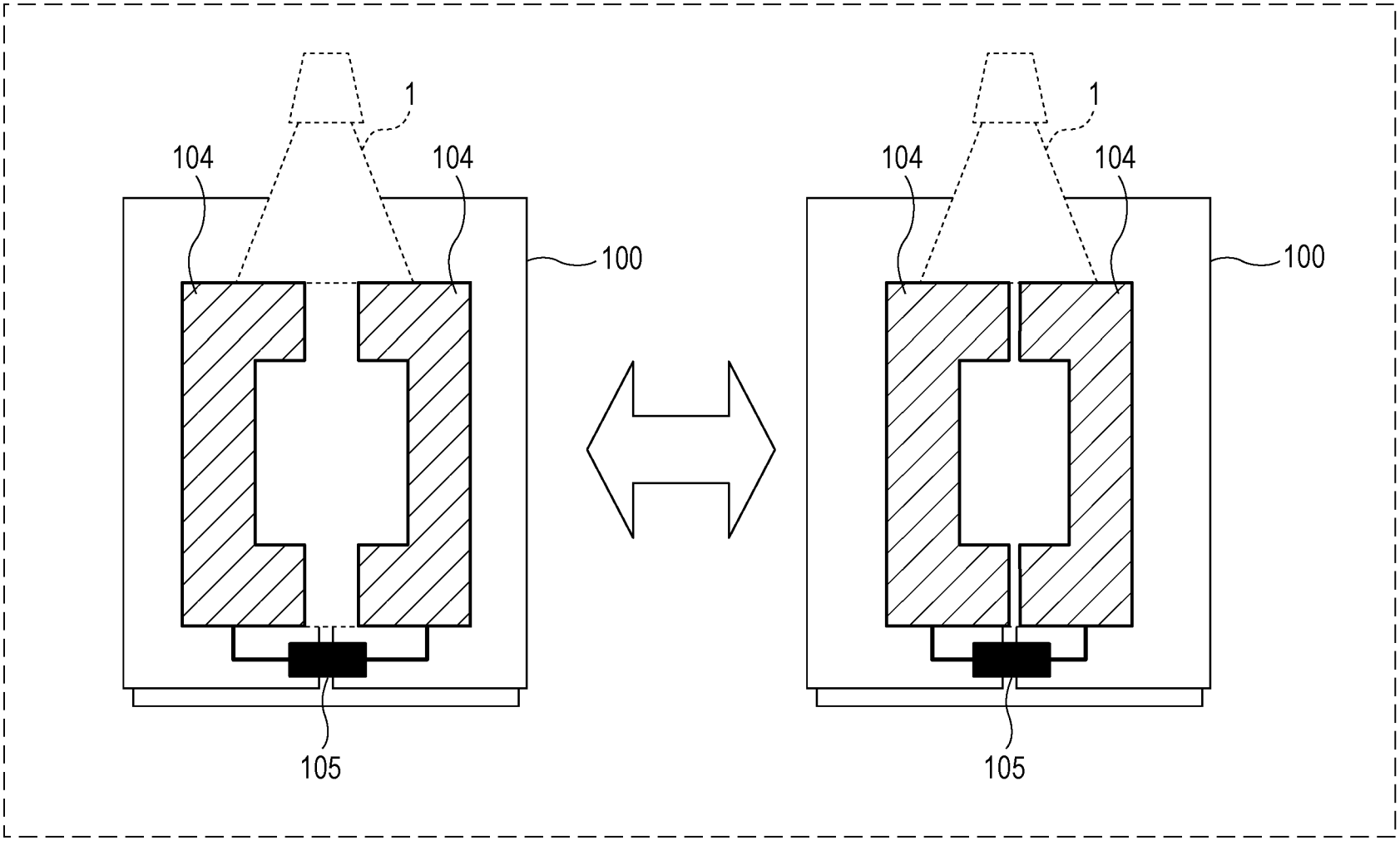
FIG. 21 is a front view of a cooling-warming apparatus that is movable in another example.

The gaps of a bottle storage according to this embodiment may have a shape other than the above-described shapes. FIGS. 20 and 21 are each a front view of the cooling-warming apparatus 104 that is movable, and the gaps have different shapes.

For example, in FIG. 20, the gaps of the cooling-warming apparatus 104 corresponding to a bottom portion of the side surface of the bottle 1 that is contained are smaller than the gaps in the other portions. In other words, a portion corresponding to the bottom side of the cooling-warming apparatus 104 projects compared with the other portions, and the area for surrounding the bottle 1 is larger than that in FIG. 3C. Thus, while maintaining the image capturing region of the image capturer 315, the cooling force can be increased.

For example, in FIG. 21, the gaps of the cooling-warming apparatus 104 corresponding to a bottom portion of the side surface of the bottle 1 that is contained and a portion thereof vertically opposite to the bottom portion are smaller than the gaps in the other portions. In other words, portions corresponding to the bottom side and the opposite side of the cooling-warming apparatus 104 project compared with the other portions, and the area for surrounding the bottle 1 is larger than that in FIG. 3C and FIG. 20. Thus, while maintaining the image capturing region of the image capturer 315, the cooling force can be further increased.

Figure 22A:
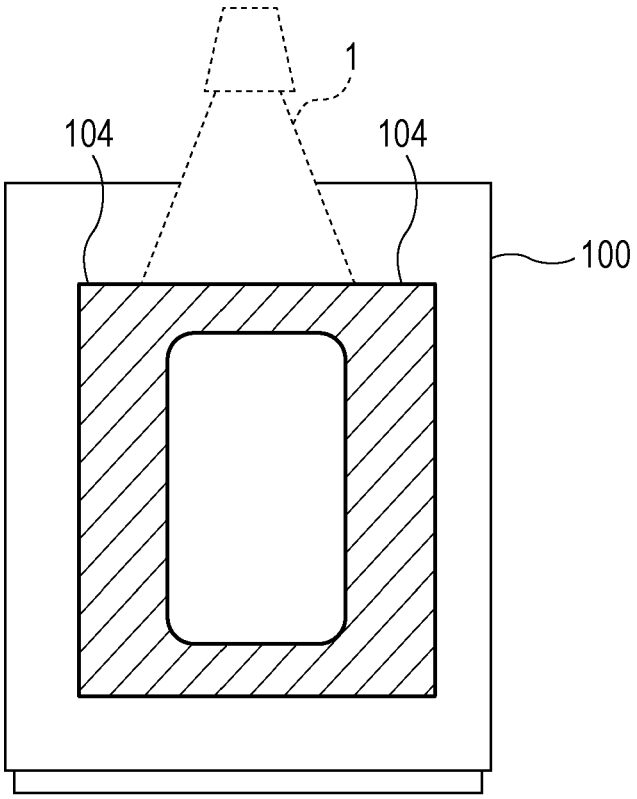
FIG. 22A is a front view of a cooling-warming apparatus that is not movable.
Figure 22B:
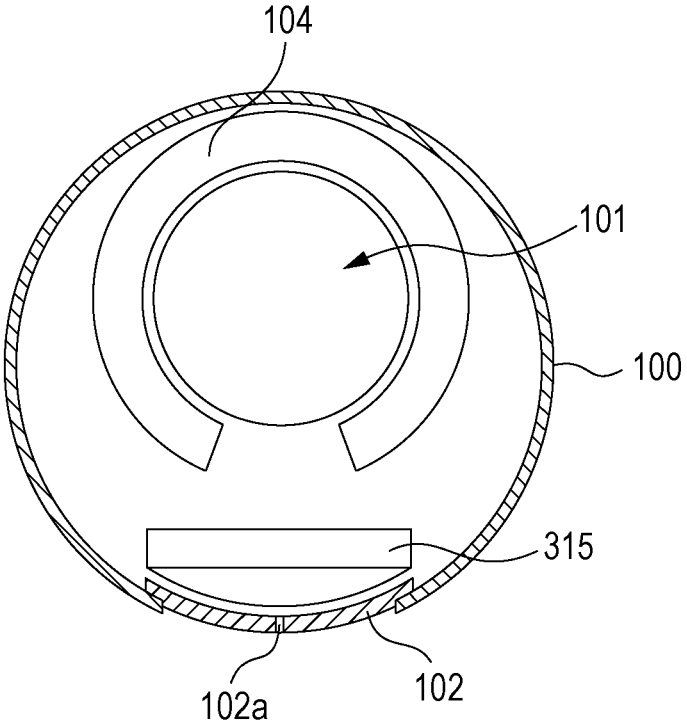
FIG. 22B is a cross-sectional view of the cooling-warming apparatus that is not movable.

In addition, in a case in which the position of the cooling-warming apparatus 104 is not adjusted, the cooling-warming apparatus 104 does not have to be divided. Thus, the shape of the cooling-warming apparatus 104 may be a shape other than the above-described shapes. FIG. 22A is a front view of the cooling-warming apparatus 104 that does not move, and FIG. 22B is a cross-sectional view of the cooling-warming apparatus 104 that does not move.

For example, FIG. 22A illustrates a case in which the cooling-warming apparatus 104 is not divided on the image capturer 315 side and in which the gap is fixed. In addition, referring to FIG. 22B, the cooling-warming apparatus 104 is not divided either on the opposite side of the image capturer 315, and no gap is provided. Thus, the cooling force of the cooling-warming apparatus 104 can be further increased. Note that the cooling-warming medium 104*a* may include a gap in accordance with the gap of the cooling-warming apparatus 104.

<7-5>

Figure 23:
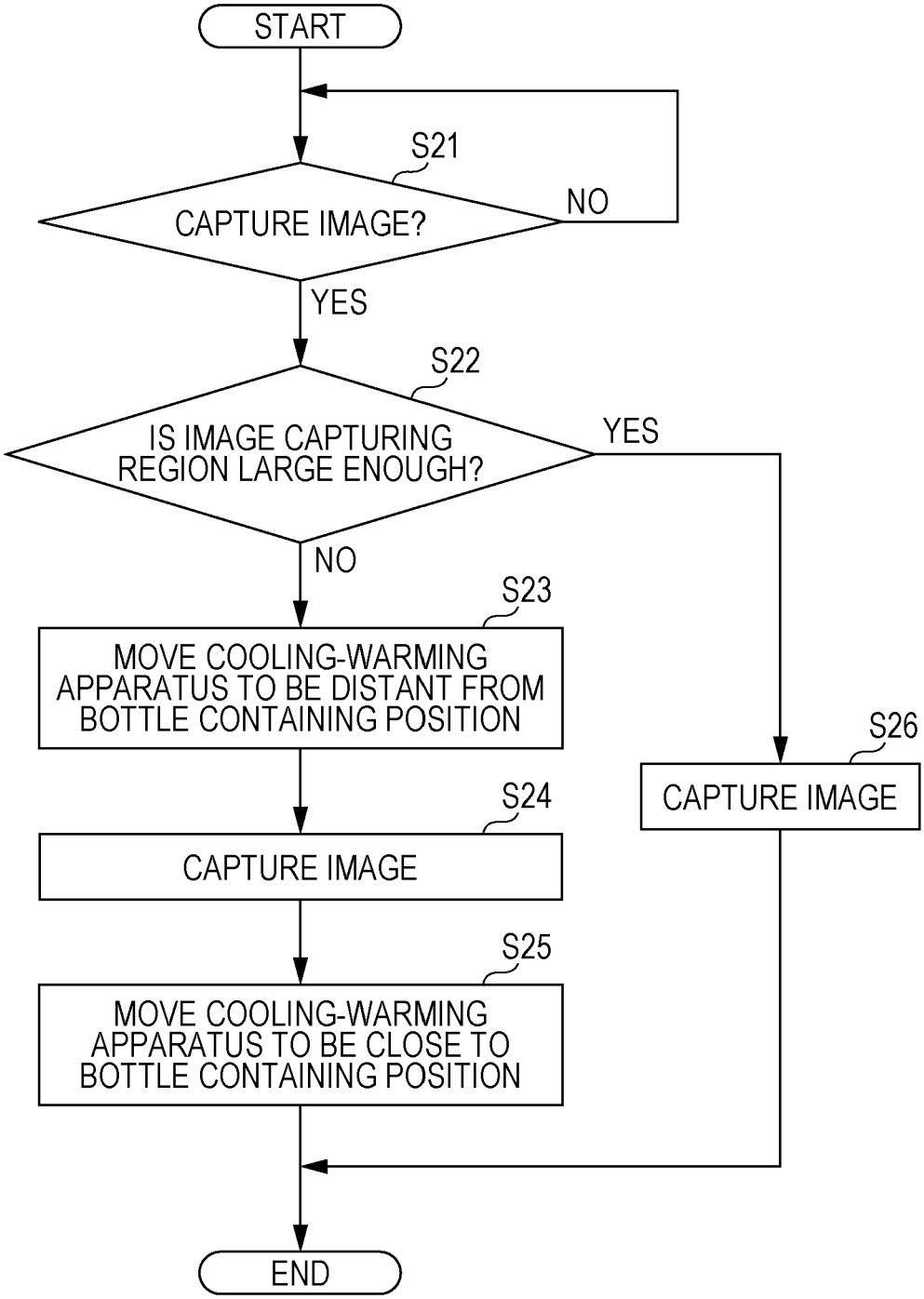
FIG. 23 is a flowchart illustrating a process for adjusting the position of the cooling-warming apparatus in accordance with image capturing.

In a bottle storage according to this embodiment, the cooling-warming apparatus may be moved in accordance with the image capturing of the image capturer 315. FIG. 23 is a flowchart illustrating an example of a process for adjusting the position of the cooling-warming apparatus 104 in accordance with the image capturing.

The controller 107 determines whether image capturing is to be performed (step S21). If it is determined that image capturing is to be performed (YES in step S21), the controller 107 determines whether the image capturing region is large enough (step S22). If it is determined that the image capturing region is not large enough (NO in step S22), the controller 107 causes the position adjuster 105 to move the cooling-warming apparatus 104 to be distant from the bottle containing position (step S23). Subsequently, the controller 107 causes the image capturer 315 to capture an image (step S24). Subsequently, the controller 107 causes the position adjuster 105 to move the cooling-warming apparatus 104 to be close to the bottle containing position (step S25). In other words, the controller 107 causes the position adjuster 105 to move the cooling-warming apparatus 104 back to its original position. Note that, if it is determined that the image capturing region is large enough (YES in step S22), the controller 107 causes the image capturer 315 to capture an image (step S26).

Thus, it is possible to more effectively perform both image capturing and cooling of the bottle.

<7-6>

Figure 24:
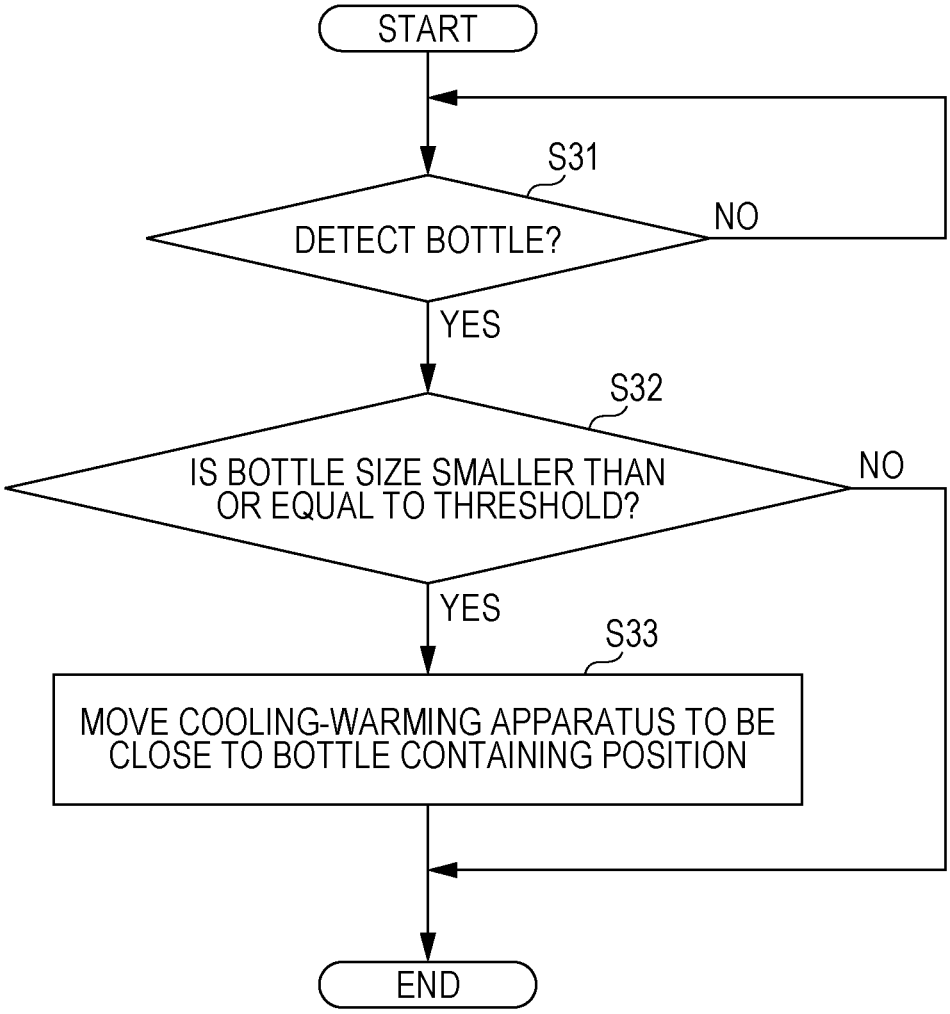
FIG. 24 is a flowchart illustrating a process for adjusting the position of the cooling-warming apparatus in accordance with the size of the bottle.

A bottle storage according to this embodiment may move the cooling-warming apparatus in accordance with the size of the bottle that is contained. For example, the size of the bottle is determined by using the weight sensor or by performing an image recognition process. FIG. 24 is a flowchart illustrating an example of a process for adjusting the position of the cooling-warming apparatus 104 in accordance with the size of the bottle.

The controller 107 determines whether a bottle has been detected (step S31). If it is determined that a bottle has been detected (YES in step S31), the controller 107 determines whether the size of the detected bottle is smaller than or equal to a threshold (step S32). If it is determined that the size of the bottle is smaller than or equal to the threshold (YES in step S32), the controller 107 causes the position adjuster 105 to move the cooling-warming apparatus 104 to be close to the bottle containing position (step S33).

Thus, even in a case in which a bottle that is smaller than an assumed size has been inserted, the cooling-warming apparatus 104 is moved to be close to the bottle containing position, and accordingly, it is possible to cool the bottle as in a case in which the size of the bottle is the assumed size. For example, the arc of the cooling-warming apparatus 104 can be optimized in accordance with the bottle.

<7-7>

A bottle storage according to this embodiment may move the cooling-warming apparatus in accordance with the contents of the bottle. Specifically, the controller 107 causes the position adjuster 105 to adjust the position of a part of the cooling-warming apparatus 104 in accordance with the remaining amount detected by the above-described remaining amount sensor 1103. For example, if the remaining amount detected by the remaining amount sensor 1103 becomes smaller than or equal to a threshold in a bottle storage including the cooling-warming apparatus 104 that is divided into two parts, as illustrated in FIG. 4 or the like, and is then further divided in the horizontal direction, the controller 107 sets two lower parts of the cooling-warming apparatus 104 among four parts as an adjustment target of the position adjuster 105. Thus, it is possible to efficiently cool the contents (e.g., beverage) of the bottle.

Note that in a case in which the cooling-warming apparatus is a Peltier device, the controller 107 may control a part of the cooling-warming apparatus to be cooled, in accordance with the remaining amount detected by the remaining amount sensor 1103. For example, if the remaining amount detected by the remaining amount sensor 1103 becomes smaller than or equal to a threshold, the controller 107 sets two lower parts of the cooling-warming apparatus 310 among four divided parts as a cooling control target.

In addition, the bottle may be moved instead of the cooling-warming apparatus. Specifically, the bottle storage further includes a raising-lowering mechanism that raises and lowers the bottle that is contained, and the controller 107 controls the raising and lowering of the raising-lowering mechanism. For example, if the remaining amount detected by the remaining amount sensor 1103 becomes smaller than or equal to a threshold, the controller 107 causes the raising-lowering mechanism to raise the bottle.

<7-8>

A bottle storage according to this embodiment may further include a rotational mechanism that rotates the bottle so as to uniformly cool the bottle by rotating the bottle. For example, if a temperature bias inside the bottle is detected, the controller 107 causes the rotational mechanism to rotate the bottle. The rotational mechanism includes a motor, and the driving of the motor rotates the bottle stand, thereby rotating the bottle. Note that the controller 107 may control the rotational speed of the bottle in accordance with the degree of the temperature bias inside the bottle. Thus, it is possible to increase the bottle cooling efficiency.

In addition, the position adjuster 105 may operate in cooperation with the above-described rotational mechanism. For example, the position adjuster 105 moves the cooling-warming apparatus 104 by using the rotation torque of the rotational mechanism. Thus, it is possible to simplify the configuration of the bottle storage and to reduce cost.

<7-9>

A bottle storage according to this embodiment may individually control the cooling performed by a plurality of Peltier devices included in the cooling-warming apparatus 310. For example, the controller 107 controls whether the plurality of Peltier devices perform cooling in a predetermined order. Alternatively, the controller 107 may control whether each of the plurality of Peltier devices performs cooling in accordance with the ambient temperature of the bottle or the temperatures of the plurality of Peltier devices. Thus, it is possible to prevent a part of the bottle from being cooled too much or to suppress a temperature bias. In addition, it is possible to suppress overheating of the Peltier devices and to efficiently discharge heat.

<7-10>

A bottle storage according to this embodiment may move the cooling-warming apparatus by using the weight of the bottle. For example, the bottle storage includes a rotational mechanism that is driven by the weight of the bottle, and the cooling-warming apparatus is moved in accordance with the rotation of the rotational mechanism. In addition, the cooling-warming apparatus may be provided with a mechanism that holds the bottle in order to fix the bottle. Thus, it is possible to omit a component such as a motor, to simplify the configuration of the bottle storage, and to reduce cost. Note that a mechanism other than the rotational mechanism may be used.

In addition, a mechanism for protecting the bottle or the label of the bottle may be provided. For example, sharp portions may be excluded from the cooling-warming apparatus. Furthermore, the cooling-warming apparatus may be disposed such that a space of a predetermined distance is provided between the cooling-warming apparatus and the bottle to be contained, and the moving range of the cooling-warming apparatus may be set. In addition, when the bottle is to be taken out, the bottle may be released from being held. For example, when the weight becomes light, the bottle is released from being held.

<7-11>

A bottle storage according to this embodiment may include a configuration for preventing air from being leaked from the opening for inserting the bottle. Specifically, the bottle storage includes an opening-closing mechanism that closes the opening upon the bottle being inserted into the container 101. For example, the opening-closing mechanism may be a mechanism such as the above-described mechanism using the weight of the bottle. In addition, the opening-closing mechanism may be an electric shutter, and upon the weight sensor detecting the weight of the bottle, the controller 107 causes the electric shutter to be closed.

In addition, instead of using the above-described configuration that physically blocks air, the bottle storage may prevent air from being leaked by using an air current. For example, the bottle storage includes an air current generator that generates an air current in the opening so as to block the opening. Upon the bottle being contained or upon starting of cooling, the controller 107 may control the air current generator. Thus, it is possible to create a wall of air between the container 101 and the outside air.

<7-12>

In a bottle storage according to this embodiment, the setting temperature of the cooling-warming apparatus 104 may be variable. Specifically, cooling-warming media 104*a* corresponding to temperatures are prepared, and a user puts, in the case 104*b*, a cooling-warming medium 104*a* corresponding to the setting temperature. The cooling-warming media 104*a* corresponding to predetermined temperature bands, such as minus 5 to 2° C., 2 to 8° C., and 8 to 10° C., are prepared. If a user puts a wrong cooling-warming medium 104*a*, the bottle may fail to be cooled at the setting temperature.

Accordingly, the controller 107 causes the display 102 or the notifier 102*a* to present a color representing a cooling-warming medium 104*a* to be put in. For example, the controller 107 acquires, from the brand database or the like, color information corresponding to the setting temperature in accordance with a brand that is identified on the basis of an image obtained from the image capturer 315, and causes the display 102 or the notifier 102*a* to display the color indicated by the acquired color information. Note that the color corresponding to the cooling-warming medium 104*a* may be presented by using a multi-color LED used for image capturing of the image capturer 315. This can prevent a user from putting a wrong cooling-warming medium 104*a*.

<8> Effects of Embodiments

As described above, according to the above embodiments, the container 101 that contains the bottle 1, the cooling-warming apparatus 104 that is provided around the container 101 for the bottle and that includes the cooling-warming medium 104*a* and the case 104*b*, and the position adjuster 105 are provided. The cooling-warming medium 104*a* is cooled or warmed outside in advance, and the case 104*b* contains the cooling-warming medium 104*a*. The position adjuster 105 moves the cooling-warming apparatus 104 such that the cooling-warming apparatus 104 becomes close to and distant from the bottle 1. Thus, by using a simple configuration, it is possible to provide an environment suitable for storing and drinking a beverage in a user-friendly manner.

In addition, the container 101 that contains the bottle 1, and the cooling-warming apparatus 310 that is provided around the container 101 for the bottle and that includes the Peltier device 312 are provided. The cooling-warming apparatus 310 includes the Peltier device 312 in which the cooling surface 312*a* faces the bottle 1 and in which the heat generating surface 312*b* faces away from the bottle 1, and includes the cooling facilitator 311 including the coolant 311*b* that cools the heat generating surface 312*b* of the Peltier device 312. Thus, by using a simple configuration, it is possible to provide an environment suitable for storing and drinking a beverage in a user-friendly manner.

Note that the present disclosure is not limited to the types, arrangements, numbers, and the like of the components in the above-described embodiments. Modifications may be made as appropriate without departing from the spirit of the disclosure by, for example, replacing a component with a component having substantially the same effects, as appropriate.

A bottle storage according to an embodiment of the present disclosure includes a container that contains a bottle; a cooling-warming apparatus provided to surround a position where the bottle is contained; and an image capturer that captures an image of the bottle contained in the container. The cooling-warming apparatus has a gap at least at a portion of the cooling-warming apparatus corresponding to at least a part of an image capturing region of the image capturer. Thus, it is possible to cool the bottle and to provide an added value based on image capturing of the bottle.

In the bottle storage according to an embodiment of the present disclosure, a position adjuster that moves the cooling-warming apparatus in at least one of a direction in which the cooling-warming apparatus becomes close to the position where the bottle is contained and a direction in which the cooling-warming apparatus becomes distant from the position where the bottle is contained may further be provided. In addition, the gap is reduced when the cooling-warming apparatus is moved to be close to the position where the bottle is contained, and is increased when the cooling-warming apparatus is moved to be distant from the position where the bottle is contained. Thus, it is possible to increase the cooling force by reducing the gap as a result of the cooling-warming apparatus becoming close and to decrease the cooling force by increasing the gap as a result of the cooling-warming apparatus becoming distant, and accordingly, too much or too little cooling can be suppressed.

In the bottle storage according to an embodiment of the present disclosure, the gap may have such a distance that the image capturing region of the image capturer includes the bottle when the cooling-warming apparatus is moved to be close to the position where the bottle is contained. Thus, it is possible to maintain the image capturing region even if the gap is reduced.

In the bottle storage according to an embodiment of the present disclosure, the gap may have such a distance that the image capturing region of the image capturer does not include the bottle when the cooling-warming apparatus is moved to be close to the position where the bottle is contained. Thus, cooling can take priority, and the cooling force for the bottle can be increased.

In the bottle storage according to an embodiment of the present disclosure, the position adjuster may move the cooling-warming apparatus in accordance with image capturing of the image capturer. Thus, it is possible to more effectively perform both image capturing and cooling.

In the bottle storage according to an embodiment of the present disclosure, the position adjuster may move the cooling-warming apparatus in such a manner that the cooling-warming apparatus becomes distant from the position where the bottle is contained, before the image capturer performs image capturing. Thus, it is possible to maintain the image capturing region while suppressing a decrease in the cooling force.

In the bottle storage according to an embodiment of the present disclosure, the position adjuster may move the cooling-warming apparatus in such a manner that the cooling-warming apparatus becomes close to the position where the bottle is contained, after the image capturer has performed image capturing. Thus, it is possible to suppress a decrease in the cooling force while maintaining image capturing opportunities.

In the bottle storage according to an embodiment of the present disclosure, the position adjuster may move the cooling-warming apparatus in accordance with a temperature of the bottle. Thus, it is possible to adjust the cooling force in accordance with the degree of cooling of the bottle and to manage the temperature of the bottle more appropriately.

In the bottle storage according to an embodiment of the present disclosure, a size detector that detects a size of the bottle may further be provided. In addition, the position adjuster may move the cooling-warming apparatus in accordance with the size that is detected. Although the distance to the cooling-warming apparatus may be variable depending on the size of the bottle so as to possibly cause too much or too little cooling, the above configuration adjusts the distance in accordance with the size. Thus, it is possible to optimize the cooling force regardless of the size.

In the bottle storage according to an embodiment of the present disclosure, a remaining amount detector that detects a remaining amount of contents of the bottle may further be provided. In addition, the position adjuster may move a part of the cooling-warming apparatus in accordance with the remaining amount that is detected. If the contents of the bottle are reduced, the contents in a bottom portion are unlikely to be cooled. However, the above configuration causes the bottom portion to be predominantly cooled if the remaining amount is reduced. Thus, the contents can be cooled more reliably.

In the bottle storage according to an embodiment of the present disclosure, the cooling-warming apparatus may include a cooling-warming medium and a case that contains the cooling-warming medium. Thus, a coolant of the related art can be used.

In the bottle storage according to an embodiment of the present disclosure, the cooling-warming apparatus may include a Peltier device in which a cooling surface faces the bottle and in which a heat generating surface faces away from the bottle, and a coolant that cools the heat generating surface of the Peltier device. Thus, cooling can be controlled more delicately.

In the bottle storage according to an embodiment of the present disclosure, the cooling-warming apparatus may be disposed such that a center of the cooling-warming apparatus is more distant from the image capturer than a center of the bottle storage. Thus, it is possible to prevent the image capturer from being cooled, otherwise causing a malfunction.

In the bottle storage according to an embodiment of the present disclosure, an information manager that identifies a brand of the bottle in accordance with an image obtained from the image capturer, and a presenter that presents the brand that is identified and related information related to the brand may further be provided. Thus, it is possible to provide an added value based on a captured image.

The bottle storage according to an embodiment of the present disclosure produces effects of cooling the bottle and of providing an added value based on image capturing of the bottle, and is suitably used as a bottle storage for a wine bottle or the like.

What is claimed is:

1. A bottle storage comprising:

a container that contains a bottle;

a cooling-warming apparatus provided to surround a position where the bottle is contained; and an image capturer that captures an image of the bottle contained in the container, wherein the cooling-warming apparatus has a gap at least at a portion of the cooling-warming apparatus corresponding to at least a part of an image capturing region of the image capturer.

2. The bottle storage according to claim 1, further comprising:

a position adjuster that moves the cooling-warming apparatus in at least one of a direction in which the cooling-warming apparatus becomes close to the position where the bottle is contained and a direction in which the cooling-warming apparatus becomes distant from the position where the bottle is contained, wherein the gap is reduced when the cooling-warming apparatus is moved to be close to the position where the bottle is contained, and is increased when the cooling-warming apparatus is moved to be distant from the position where the bottle is contained.

3. The bottle storage according to claim 2, wherein the gap has such a distance that the image capturing region of the image capturer includes the bottle when the cooling-warming apparatus is moved to be close to the position where the bottle is contained.

4. The bottle storage according to claim 2, wherein the gap has such a distance that the image capturing region of the image capturer does not include the bottle when the cooling-warming apparatus is moved to be close to the position where the bottle is contained.

5. The bottle storage according to claim 2, wherein the position adjuster moves the cooling-warming apparatus in accordance with image capturing of the image capturer.

6. The bottle storage according to claim 5, wherein the position adjuster moves the cooling-warming apparatus in such a manner that the cooling-warming apparatus becomes distant from the position where the bottle is contained, before the image capturer performs image capturing.

7. The bottle storage according to claim 5, wherein the position adjuster moves the cooling-warming apparatus in such a manner that the cooling-warming apparatus becomes close to the position where the bottle is contained, after the image capturer has performed image capturing.

8. The bottle storage according to claim 2, wherein the position adjuster moves the cooling-warming apparatus in accordance with a temperature of the bottle.

9. The bottle storage according to claim 2, further comprising:

a size detector that detects a size of the bottle, wherein the position adjuster moves the cooling-warming apparatus in accordance with the size that is detected.

10. The bottle storage according to claim 2, further comprising:

a remaining amount detector that detects a remaining amount of contents of the bottle, wherein the position adjuster moves a part of the cooling-warming apparatus in accordance with the remaining amount that is detected.

11. The bottle storage according to claim 1, wherein the cooling-warming apparatus includes a cooling-warming medium and a case that contains the cooling-warming medium.

12. The bottle storage according to claim 1, wherein the cooling-warming apparatus includes a Peltier device in which a cooling surface faces the bottle and in which a heat generating surface faces away from the bottle, and a coolant that cools the heat generating surface of the Peltier device.

13. The bottle storage according to claim 1, wherein the cooling-warming apparatus is disposed such that a center of the cooling-warming apparatus is more distant from the image capturer than a center of the bottle storage.

14. The bottle storage according to claim 1, further comprising:

an information manager that identifies a brand of the bottle in accordance with an image obtained from the image capturer; and a presenter that presents the brand that is identified and related information related to the brand.

* * * * *